US012521607B2

(12) United States Patent
Jeong et al.

(10) Patent No.: US 12,521,607 B2
(45) Date of Patent: Jan. 13, 2026

(54) ELECTRONIC APPARATUS FOR PROVIDING PERSONALIZED EXERCISE COACHING AND OPERATING METHOD THEREOF

(71) Applicant: Samsung Electronics Co., Ltd., Gyeonggi-do (KR)

(72) Inventors: Seongook Jeong, Gyeonggi-do (KR); Seungwok Han, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 315 days.

(21) Appl. No.: 18/198,436

(22) Filed: May 17, 2023

(65) Prior Publication Data

US 2023/0285808 A1 Sep. 14, 2023

Related U.S. Application Data

(63) Continuation of application No. PCT/KR2022/006107, filed on Apr. 28, 2022.

(30) Foreign Application Priority Data

May 3, 2021 (KR) ..... 10-2021-0057362

(51) Int. Cl.
*A63B 24/00* (2006.01)
*A63B 71/06* (2006.01)

(52) U.S. Cl.
CPC ..... *A63B 24/0075* (2013.01); *A63B 24/0062* (2013.01); *A63B 2071/0661* (2013.01);
(Continued)

(58) Field of Classification Search
CPC ..... A63B 22/0605; A63B 22/0664; A63B 2022/0611; A63B 2022/0652;
(Continued)

(56) References Cited

U.S. PATENT DOCUMENTS 3,455,295 A * 7/1969 Kellogg ..... A63B 22/001 482/904
4,973,046 A * 11/1990 Maxwell ..... A63B 22/0694 601/36

(Continued)

FOREIGN PATENT DOCUMENTS

JP 2004-28674 A 1/2004
JP 2007-115200 A 5/2007

(Continued)

OTHER PUBLICATIONS

Extended European Search Report dated Jun. 20, 2024.

*Primary Examiner* — Zachary T Moore
(74) *Attorney, Agent, or Firm* — Cha & Reiter, LLC.

(57) ABSTRACT

An electronic device and method are disclosed. The electronic device includes a memory, a communication circuit, a sensor module, an output module, and a processor. The processor implements the method, including: detecting movement of a user corresponding to real-time performance of an exercise by the user, detecting environmental information for an environment in which the exercise is performed, outputting, through an output module, a user interface (UI) including guidance for the performance of the exercise, based on one or more of a historic exercise record for a past exercise event performed at the environment in which the exercise is performed, a stored profile of the user, and the detected movement of the user corresponding to the real-time performance of the exercise.

12 Claims, 25 Drawing Sheets

(52) U.S. Cl.
CPC ..... *A63B 2220/70* (2013.01); *A63B 2220/803* (2013.01); *A63B 2220/836* (2013.01); *A63B 2225/50* (2013.01)

(58) Field of Classification Search
CPC ..... A63B 22/16; A63B 22/18; A63B 24/0075; A63B 24/0062; A63B 2220/77; A63B 2220/803; A63B 2220/836; A63B 2225/50
See application file for complete search history.

(56) References Cited

U.S. PATENT DOCUMENTS

| | | | | |
|---|---|---|---|---|
| 6,839,626 | B2 | 1/2005 | Yamakita et al. | |
| 7,254,516 | B2 | 8/2007 | Case, Jr. et al. | |
| 9,248,340 | B2 | 2/2016 | Hoffman et al. | |
| 10,599,816 | B2 | 3/2020 | Orenstein et al. | |
| 11,583,719 | B2 * | 2/2023 | Weisz | A63B 23/03541 |
| 2004/0142797 | A1 * | 7/2004 | Andre | A63B 22/0694 482/57 |
| 2008/0109158 | A1 | 5/2008 | Huhtala et al. | |
| 2011/0140897 | A1 | 6/2011 | Purks et al. | |
| 2011/0275487 | A1 * | 11/2011 | Richards | B63B 34/50 482/57 |
| 2012/0283855 | A1 | 11/2012 | Hoffman et al. | |
| 2013/0304377 | A1 | 11/2013 | Van Hende | |
| 2016/0107064 | A1 * | 4/2016 | Hoffman | A61B 5/0022 700/91 |
| 2016/0178751 | A1 | 6/2016 | Shaw et al. | |
| 2019/0063926 | A1 | 2/2019 | Xu et al. | |

FOREIGN PATENT DOCUMENTS

| | | | |
|---|---|---|---|
| JP | 2010-75715 | A | 4/2010 |
| JP | 5268155 | B2 | 5/2013 |
| JP | 2018-68669 | A | 5/2018 |
| JP | 2019-150649 | A | 9/2019 |
| KR | 10-2013-0045382 | A | 5/2013 |
| KR | 10-2016-0108808 | A | 9/2016 |
| KR | 10-1940948 | B1 | 1/2019 |
| KR | 10-2019-0023396 | A | 3/2019 |
| KR | 10-1931724 | B1 | 3/2019 |
| KR | 10-2019-0045475 | A | 5/2019 |
| KR | 10-2019-0066797 | A | 6/2019 |
| WO | 2014/144258 | A2 | 9/2014 |

* cited by examiner

ELECTRONIC APPARATUS FOR PROVIDING PERSONALIZED EXERCISE COACHING AND OPERATING METHOD THEREOF

CROSS-REFERENCE TO RELATED APPLICATION(S)

This application is a continuation of International Application No. PCT/KR2022/006107, which was filed on Apr. 28, 2022, and claims priority to Korean Patent Application No. 10-2021-0057362, filed on May 3, 2021, in the Korean Intellectual Property Office, the disclosures of which are incorporated by reference herein their entirety.

BACKGROUND

Technical Field

Various embodiments described in this disclosure relate to an electronic device and an operating method thereof and, more particularly, to an electronic device for providing personalized exercise coaching and an operating method thereof.

Description of Related Art

An electronic device (e.g., a smartphone, a mobile terminal, or a wearable device such as a smartwatch) may monitor exercise information in the form of various electrical signals generated from one or more sensors, analyze the information, and store analysis results by interoperation with an application (e.g., a health application) or provide guidance (e.g., simulated exercise coaching) according to the results of the analysis.

For example, in the case of running, which is one of the most commonly performed exercises, it is important to tailor the run relative to a user's physical fitness level, as runners are often injured as a typical running gait may require the feet to support up to three-times the body weight of the runner. Accordingly, the provision of exercise guidance for a runner may involve coaching that suggests an appropriate pace or posture for the runner to lower the risk of injury.

For example, when a user goes on a run while wearing a smartwatch, a smartwatch app (e.g., a health application) may collect exercise information for the user's performance, such as running pace, running distance, and heart rate, as monitored through sensors of the smartwatch, and provide guidance to the runner, or display running posture evaluation items on a screen after the exercise. Personalized coaching reflecting the personal characteristics of a user (e.g., physical strength and muscle strength levels of a user), the unique characteristics of exercise, or an exercise environment may be required for proper exercise coaching.

Simple exercise coaching, which focuses on providing post-exercise evaluation results, may make it difficult for the user to objectively recognize or evaluate his or her exercise posture during exercise to correct the exercise posture.

An inappropriate exercise guide for the characteristics of the exercise performed by the user or the exercise posture of the user may reduce the effectiveness of the exercise or increase the risk of injury.

If exercise coaching is performed in a situation where posture cannot be corrected immediately during exercise due to the personal characteristics of a user (e.g., physical characteristics such as weight, age, and joint status), feedback by a direct input of the user or reflecting the existing exercise results may not be reflected in real time.

SUMMARY

Various embodiments described in this disclosure may provide an electronic device for providing personalized exercise coaching capable of increasing the accuracy and efficiency of coaching by appropriately matching the current exercise environment with past exercise records, and an operating method thereof.

Various embodiments described in this disclosure may provide an electronic device for providing personalized exercise coaching capable of preventing injury and increasing exercise effect by reflecting feedback according to real-time exercise analysis in coaching, and an operating method thereof.

Various embodiments described in this disclosure may provide an electronic device that is able to provide personalized algorithmic exercise coaching, enabling user-customized guidance that reflects personal characteristics of a user (e.g., physical strength and muscle strength levels of the user), and an operating method thereof.

An electronic device according to various embodiments may include a memory, a communication circuit, a sensor module, an output module, and at least one processor operably coupled to the memory, the communication circuit, the sensor module and the output module. The memory stores instructions executable by the processor to: detect, through the sensor module, movement of a user corresponding to real-time performance of an exercise by the user, detect, using at least one of the sensor module and the communication circuit, environmental information for an environment in which the exercise is performed, and output, through the output module, a user interface (UI) including guidance for performance of the exercise, based on: a historic exercise record for a past exercise event performed at the environment in which the exercise is performed, a stored profile of the user, and the detected movement of the user corresponding to the real-time performance of the exercise.

An operating method of an electronic device according to various embodiments may include: detecting, via a sensor module, movement of a user corresponding to real-time performance of an exercise by the user, detecting, using at least one of the sensor module and a communication circuit, environmental information for an environment in which the exercise is performed, and outputting, through an output module, a user interface (UI) including guidance for the performance of the exercise, based on a historic exercise record for a past exercise event performed at the environment in which the exercise is performed, a stored profile of the user, and the detected movement of the user corresponding to the real-time performance of the exercise. According to various embodiments, it is possible to increase the accuracy and efficiency of algorithmic simulated exercise coaching by matching the current exercise environment against historic exercise records.

According to various embodiments, it is possible to reduce occurrence of injuries and increase benefits from exercise by facilitating real-time exercise analysis to provide real-time feedback on performance of the exercise.

According to various embodiments, algorithmic coaching and guidance may be tailored to the user's stored characteristics (e.g., the physical strength and muscle strength levels of the user).

In addition, various effects that are directly or indirectly recognized may be provided through this disclosure.

DETAILED DESCRIPTION

Hereinafter, various embodiments will be described with reference to the accompanying drawings.

Figure 1:
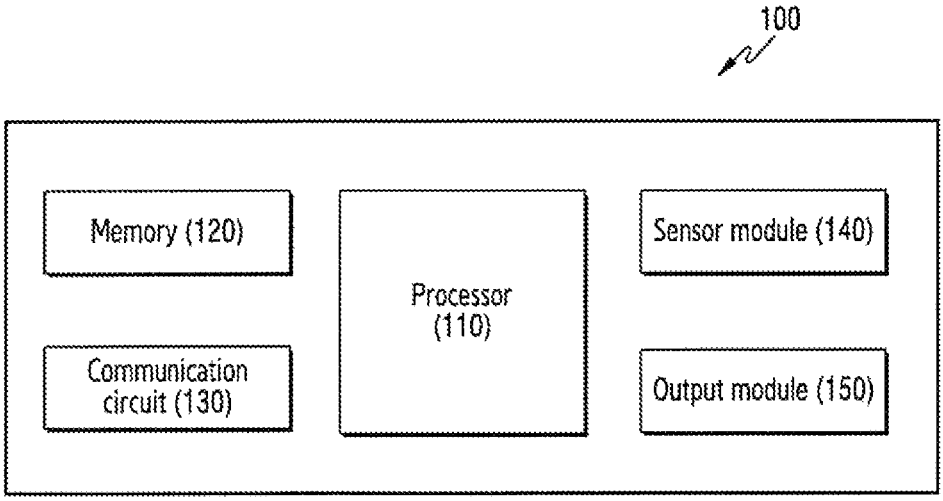
FIG. 1 is a block diagram of an electronic device according to an embodiment.

FIG. 1 is a block diagram of an electronic device according to an embodiment.

An electronic device 100 according to an embodiment may be intended to provide personalized exercise coaching. For example, the electronic device 100 may be implemented as any one type of a smartphone, a flexible smartphone, a wearable device (e.g., a smartwatch, smart glasses, or a smart ring), and a wireless ear-set.

Referring to FIG. 1, the electronic device 100 according to an embodiment may include a processor 110, a memory 120, a communication circuit 130, an output module 150, and/or a sensor module 140. The electronic device 100 may exclude at least one of the elements or further include other elements.

The processor 110, the memory 120, the communication circuit 130, the output module 150, and/or the sensor module 140 included in the electronic device 100 may be electrically and/or operably connected to each other to exchange signals (e.g., commands or data) with each other.

Figure 17:
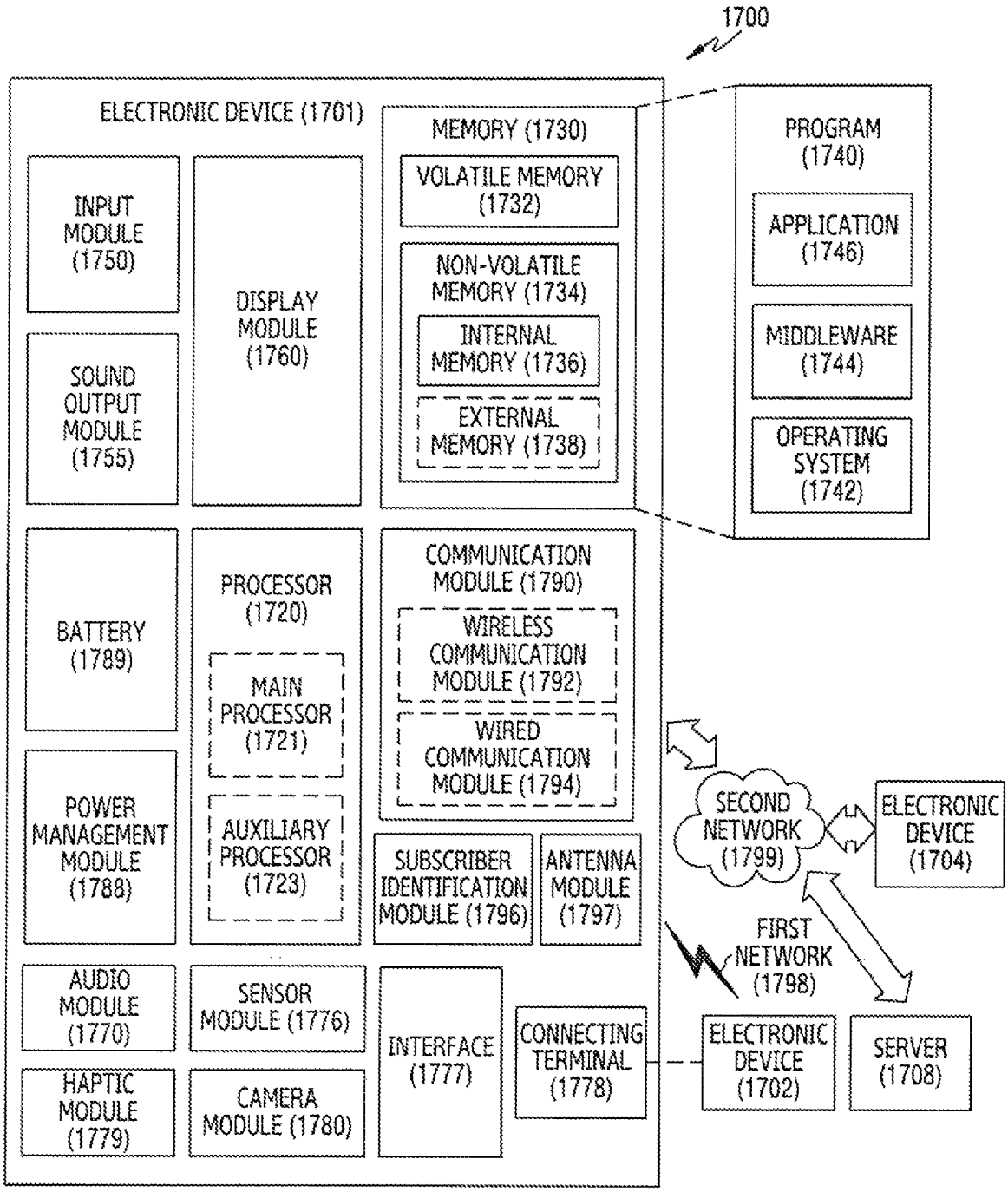
FIG. 17 is a block diagram of an electronic device in a network environment, according to various embodiments.

The electronic device 100 may include at least a part of the electronic device 1701 illustrated in FIG. 17. For example, the processor 110 may correspond to the processor 1720 (one of 1721 or 1723) in FIG. 17. The memory 120 may include at least a portion of the memory 1730 in FIG. 17. The communication circuit 130 may include the communication module 1790 in FIG. 17. The sensor module 140 may correspond to the sensor module 1776 in FIG. 17 or include a portion thereof. The output module 150 may include at least some of the display module 1760, the audio module 1770, the sound output module 1755, and the haptic module 1779 in FIG. 17.

In an embodiment, the processor 110 may include at least one processor. For example, the processor 110 may include at least one of an application processor (AP) (e.g., the main processor 1721 in FIG. 17) and a communication processor (CP) (e.g., a coprocessor 1723).

The processor 110 may execute and/or control various functions supported by the electronic device 100. The processor 110 may control at least some of the memory 120, the communication circuit 130, the output module 150, and the sensor module 140. The processor 110 may execute a code written in programming languages stored in the memory 120 of the electronic device 100, thereby executing applications and controlling a variety of hardware. For example, the processor 110 may execute an application (e.g., a health application, a healthcare application, an exercise application, or a fitness application) and provide a personalized exercise coaching function using the application. The application executed in the electronic device 100 may operate independently or in conjunction with the external electronic device (e.g., the electronic device 1702 or the electronic device 1704 in FIG. 17).

As instructions stored in the memory 120 are executed, the operations of the processor 110 may be performed.

In an embodiment, the sensor module 140 may include at least one sensor. For example, the sensor module 140 may include one or more of an acceleration sensor, a gyro sensor, an atmospheric-pressure sensor (or an altitude sensor), and a biometric sensor (e.g., a photoplethysmogram (PPG) sensor, an electrocardiography (ECG) sensor, a galvanic skin response (GSR) sensor, or a bioelectrical impedance analysis (BIA) sensor).

In an embodiment, the sensor module 140 may output at least some of motion data on the movement of the electronic device 100, user biometric data, and environment data. For example, motion data (e.g., data on some of pace, distance, time, cadence, up-down motion, left-right motion, and stride length) may be output through an acceleration sensor and/or a gyro sensor. User biometric data (e.g., heart rate or blood pressure data) may be output through a biometric sensor. Environment data (e.g., data on altitude or atmospheric pressure) may be output through an atmospheric-pressure sensor (or an altitude sensor).

In an embodiment, the sensor module 140 may detect real-time exercise performance information (e.g., pace, distance, time, cadence, up-down motion, left-right motion, stride length, heart rate, and blood pressure) according to movement of a user. For example, real-time exercise performance information may correspond to at least some of motion data and biometric data output from the sensor module 140.

According to an embodiment, the communication circuit 130 may include a wireless communication module (e.g., the wireless communication module 1792 in FIG. 17) (e.g., a cellular communication module, a short-range wireless communication module, or a global navigation satellite system (GNSS) communication module).

In an embodiment, the communication circuit 130 may support short-range wireless communication connection of the electronic device 100. For example, the communication circuit 130 may support connection of short-range wireless communication (e.g., Bluetooth, Bluetooth low-energy (LE), wireless fidelity (Wi-Fi) direct, or infrared data association (IrDA)) between the electronic device 100 and an external electronic device (e.g., a smartphone carried by the user or a wearable device worn on the user during exercise).

In an embodiment, the communication circuit 130 may support long-range wireless communication connection of the electronic device 100. For example, the communication circuit 130 may receive at least some of positioning data and weather data through long-range wireless communication and transmit the same to the processor 110. For example, the communication circuit 130 may support connection of long-range wireless communication (e.g., cellular communication or the Internet) between an external server and the electronic device 100 and receive data (e.g., weather data) corresponding to current exercise environment information from the external server. As another example, the communication circuit 130 may support GNSS communication connection between a satellite and the electronic device 100 for positioning the electronic device 100 and receive data (e.g., positioning data) corresponding to current exercise environment information from the satellite.

In an embodiment, the output module 150 may include one or more modules for providing a user interface. For example, the output module 150 may include one or more of a display (e.g., the display module 1760 in FIG. 17), an audio module (e.g., the audio module 1770), a sound output module (e.g., the sound output module 1755), and a haptic module (e.g., the haptic module 1779).

In an embodiment, the processor 110 may detect real-time exercise performance information according to movement of a user through the sensor module 140. For example, real-time exercise performance information may include information on any one of pace, distance, time, cadence, up-down motion, left-right motion, stride length, heart rate, and blood pressure. For example, real-time exercise performance information may include at least some of motion data (e.g., data on at least some of pace, distance, time, cadence, up-down motion, left-right motion, and stride length) output from the sensor module 140 (e.g., an accelerometer and/or a gyro sensor) and biometric data (e.g., data on heart rate or blood pressure) output from the sensor module 140 (e.g., a biometric data), or data (e.g., processed data) corresponding thereto.

In an embodiment, the processor 110 may obtain current exercise environment information using the sensor module 140 or the communication circuit 130.

For example, current exercise environment information may include one or more of place information, weather situation information, and user situation information. For example, place information may include information on one or more of a location and terrain (e.g., altitude, slope, uphill, downhill, and ground status). Weather situation information may include information on one or more of weather, temperature, humidity, wind direction, and wind strength. User situation information may include information on one or more of exercise direction and exercise routes. For example, current exercise environment information may include at least some of environment data (e.g., data on altitude or atmospheric pressure) output from the sensor module 140 (e.g., an atmospheric-pressure sensor), positioning data received through the communication circuit 130 (e.g., a GNSS communication module), and weather data received through the communication circuit 130 (e.g., a cellular communication module), or data (e.g., processed data) corresponding thereto.

For example, the current exercise environment information (e.g., information on the altitude among the place information) may be obtained (e.g., detected) through the sensor module 140 (e.g., an atmospheric-pressure sensor). As another example, the current exercise environment information (e.g., information on the location among the place information) may be obtained through the communication circuit 130 (e.g., received from a satellite through a GNSS communication module). As another example, the current exercise environment information (e.g., weather situation information) may be obtained through the communication circuit 130 (e.g., collected from an external server through the Internet). As another example, the current exercise environment information (e.g., user situation information such as exercise direction and exercise routes) may be obtained as a result of processing or calculating information obtained through the sensor module 140 or the communication circuit 130.

In an embodiment, the processor 110 may provide a user interface for exercise coaching or output a user interface including guidance for performance of the exercise, through the output module 150 or the communication circuit 130, based on past exercise record information corresponding to current exercise environment information, user profile information, and real-time exercise performance information. For example, the past exercise record information may be information corresponding to at least one of a place, a weather situation, and a user situation indicated by the current exercise environment information. For example, the user profile information may include information on one or more of age, gender, health status, and an exercise goal set by a user.

In an embodiment, the user interface for exercise coaching may be implemented as a visual type (e.g., a screen or text), an auditory type (e.g., audio or sound), a tactile type (e.g., vibration), or a hybrid type that is a combination of at least some thereof.

For example, the processor 110 of the electronic device 100 may output a user interface for exercise coaching through the output module 150 (e.g., at least one of a display, an audio module, a sound output module, and a haptic module). The processor 110 may output a user interface in a visual type, an auditory type, a tactile type, or a hybrid type to the user through the output module 150.

As another example, the processor 110 may transmit information on the user interface to one or more external electronic devices through the communication circuit 130 so that the user interface (e.g., a screen, text, voice, or vibration) is output through the external electronic device. The external electronic device may be in the state of being connected to the electronic device 100 through short-range wireless communication using the communication circuit 130. For example, in the state in which the electronic device 100 (e.g., a smartphone type electronic device) carried by a user during exercise and an external electronic device (e.g., a smartwatch type electronic device) worn on the user are connected by short-range wireless communication, the electronic device 100 may transmit information on the user interface for exercise coaching to the smartwatch, thereby outputting the user interface (e.g., a voice guide) through the smartwatch.

In an embodiment, when providing exercise coaching based on current exercise environment information, the processor 110 may provide exercise coaching for different exercise zones (e.g., places and locations).

For example, the processor 110 may obtain past exercise record information corresponding to a current zone, based on current exercise environment information. The processor 110 may provide a user interface for exercise coaching for the current zone, based on the past exercise record information.

As another example, the processor 110 may obtain past exercise record information corresponding to the current zone and the next zone of the current zone, based on current exercise environment information. The processor 110 may provide a user interface for exercise coaching for the next zone, based on the past exercise record information.

As another example, the processor 110 may obtain past exercise record information for an entire exercise zone including the current zone, based on current exercise environment information. The processor 110 may provide a user interface for exercise coaching for each for a plurality of zones of the entire exercise zone, based on past exercise record information.

In an embodiment, the processor 110 may determine whether a current zone belongs to a warm-up zone, a main exercise zone, and a cool-down zone in the entire exercise zone, based on real-time exercise performance information. The processor 110 may provide a user interface for exercise coaching by further considering the zone to which the current zone belongs.

In an embodiment, the processor 110 may determine the current state to be one of a pre-exercise state, an in-exercise state, and a post-exercise state, based on real-time exercise performance information. The processor 110 may provide a user interface for exercise coaching by further considering the state corresponding to the current state.

In an embodiment, the processor 110 may control the output module 150 or the communication circuit 130 and provide a user interface for personalized exercise coaching through the output module 150 or the communication circuit 130.

In an embodiment, the user interface for exercise coaching may be provided in various types.

In an embodiment, the processor 110 may determine a coaching providing method (or select a format of guidance of performance of an exercise), based on at least one of the user interface type (e.g., at least one of the visual type, the auditory type, the tactile type, or the hybrid type), information on one or more electronic devices worn on the user (e.g., information on one or more external electronic devices connected to the electronic device 100 through short-range wireless communication), and device priority information. The processor 110 may provide a user interface for exercise coaching, based on the coaching providing method.

In an embodiment, the user interface provided through the electronic device 100 may be intended for running coaching and may be related to information on one or more of the degree of left-right asymmetry, flight time, ground contact time, stiffness, vertical amplitude, and regularity according to running posture evaluation items. For example, the processor 110 of the electronic device 100 (e.g., a smart phone) may provide user interfaces as illustrated in FIGS. 7A, 7B, 8A, 8B, 8C, 8D, 9, 10A, 10B, 11, 12, 13A, 13B, 14A, 14B, 14C, 15, and 16, independently and/or interworking with other electronic device (e.g., a wearable device, a wireless ear-set).

In various embodiments disclosed in the disclosure, although the electronic device 100 is exemplified as a smartphone type, the type of electronic device is not limited thereto, and the electronic device may be implemented in various types such as a smartphone, a flexible smartphone, a wearable device (e.g., a smartwatch, smart glasses, or a smart ring), and a wireless ear-set.

Figure 2:
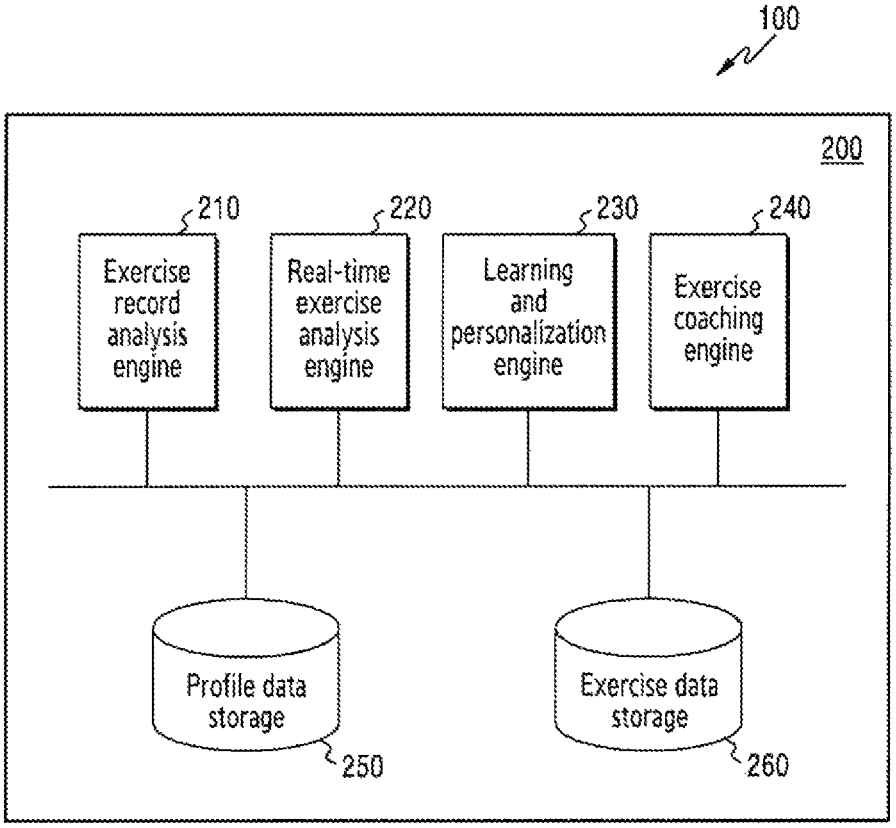
FIG. 2 is a block diagram illustrating the configuration for each module of an electronic device according to an embodiment.

FIG. 2 is a block diagram illustrating the configuration for each module of an electronic device according to an embodiment.

In various embodiments, the electronic device 100 may include additional elements in addition to the element illustrated in FIG. 2 or exclude at least one of the elements illustrated in FIG. 2. The configuration shown in FIG. 2 may not have to be implemented as physically separate hardware. The processor (e.g., the processor 110 in FIG. 1) of the electronic device 100 may execute instructions stored in a memory (e.g., the memory 120 in FIG. 1) in order to implement the elements illustrated in FIG. 2 and control hardware (e.g., the communication circuit 130 in FIG. 1) related to operations and/or functions. For example, a profile data storage 250 and an exercise data storage 260 may be stored in one storage medium or stored as one database.

According to some embodiments, at least some of the elements shown in FIG. 2 may be implemented by at least one external electronic device.

According to some embodiments, some elements (e.g., a learning and personalization engine 230) may be implemented in an external electronic device. The learning and/or the operation of the learning and personalization engine 230 may be performed in the external electronic device.

The electronic device 100 according to an embodiment may include a personalized coaching engine 200 as illustrated.

Referring to FIG. 2, the personalized coaching engine 200 may include an exercise record analysis engine 210, a real-time exercise analysis engine 220, a learning and personalization engine 230, and an exercise coaching engine 240. The personalized coaching engine 200 may include a profile data storage 250 and an exercise data storage 260.

At least some of the personalized coaching engine 200 (e.g., the learning and personalization engine 230) may analyze input information and produce output information using the learning model learned using a rule-based model or an artificial intelligence algorithm. At least some of the personalized coaching engine 200 (e.g., the learning and personalization engine 230) may use an artificial intelligence model learned according to at least one of machine learning, a neural network, or a deep learning algorithm.

In an embodiment, the exercise record analysis engine 210 may perform history-based exercise analysis. The exercise record analysis engine 210 may provide a past exercise analysis result based on the history by analyzing past exercise record information. The exercise record analysis engine 210 may perform history-based exercise analysis using a variety of input information and provide an analysis result thereof to the learning and personalization engine 230.

For example, input information of the exercise record analysis engine 210 may include past exercise record information. The past exercise record information may include one or more pieces of basic exercise information, exercise environment information, exercise information according to goal setting, and exercise evaluation information. For example, the exercise record analysis engine 210 may read the input information stored in the exercise data storage 260 and use the same for analysis.

For example, output information of the exercise record analysis engine 210 may include one or more pieces of evaluation information for each exercise zone and evaluation information for each exercise time for past exercise record information. For example, the output information may include evaluation information for each zone or for every minute in relation to one or more of the frequency of exercise, a period, pace, heart rate, time, temperature, humidity, wind direction, wind strength, terrain, regularity, vertical amplitude, ground contact time, stiffness, and flight time. As another example, the output information may include information on the situation in which the user gets a bad evaluation. As another example, the output information may include information on the situation in which the user gets a good evaluation.

In an embodiment, the exercise record analysis engine 210 may identify and past exercise record information corresponding to current exercise environment information and use the same for analysis. For example, the exercise record analysis engine 210 may retrieve past exercise environment the same as or similar to the current exercise environment (e.g., place or weather) from the exercise data storage 260, and identify and extract the past exercise record information matching the past exercise environment. For example, the past exercise record information may include basic exercise information and/or exercise evaluation information.

In an embodiment, the exercise record analysis engine 210 may analyze extracted past exercise record information and transmit an analysis result thereof to the learning and personalization engine 230.

In an embodiment, the real-time exercise analysis engine 220 may perform real-time exercise analysis.

For example, the real-time exercise analysis engine 220 may perform real-time exercise analysis based on at least one piece of real-time exercise performance information and/or current exercise environment information. For example, real-time exercise analysis may be performed based on the exercise distance and/or exercise time among the real-time exercise performance information. As another example, if the exercise pace is higher than a configured value or if the heart rate is higher than a configured value, real-time exercise analysis may be performed. As another example, real-time exercise analysis may be performed based on terrain (e.g., flat ground, uphill, or downhill) among the current exercise environment information. As another example, if the degree of change in the current exercise environment information is high (e.g., if the slope change is greater than or equal to a threshold value), real-time exercise analysis may be performed.

In an embodiment, the real-time exercise analysis engine 220 may provide the real-time exercise analysis result by analyzing input information collected during exercise.

For example, input information of the real-time exercise analysis engine 220 may include one or more pieces of real-time exercise performance information of a user, current exercise environment information, and/or exercise coaching information fed back from the learning and personalization engine 230 (e.g., information on a personalized goal-based coaching providing method or a coaching possibility determination result). For example, in relation to the target degree of left-right asymmetry, feedback indicating "The degree of left and right symmetry is very poor during the entire exercise" may be transmitted. As another example, feedback indicating the target cadence of 170 spm may be transmitted in relation to regularity. As another example, in relation to terrain, feedback on the average cadence within m, a pace change, a heart rate, and the current degree of left-right asymmetry may be transmitted.

For example, output information of the real-time exercise analysis engine 220 may include information about an analysis result reflecting current exercise environment information. For example, an analysis result indicating "The average cadence within 20 m has been increasing, the pace is increasing, and the heart rate remains constant" may be output.

In an embodiment, the real-time exercise analysis engine 220 may transmit the real-time exercise analysis result to the learning and personalization engine 230 and/or the exercise record analysis engine 210.

In an embodiment, the real-time exercise analysis engine 220 may receive exercise coaching information (e.g., personalized feedback item information) from the learning and personalization engine 230.

For example, the real-time exercise analysis engine 220 may produce a real-time exercise analysis result based on exercise coaching information and transmit the real-time exercise analysis result to the learning and personalization engine 230. For example, if there is user feedback after exercise coaching, the real-time exercise analysis engine 220 may perform real-time exercise analysis by reflecting the user feedback (e.g., a change in the target cadence and a change in the target pace).

In an embodiment, the learning and personalization engine 230 may perform integrated analysis and/or learning using the history-based past exercise analysis result transmitted from the exercise record analysis engine 210 and/or the real-time exercise analysis result transmitted from the real-time exercise analysis engine 220 to produce exercise coaching information. For example, the exercise coaching information may include personalized feedback item information suitable for the user.

For example, the learning and personalization engine 230 may use, in real-time, real-time information including real-time exercise performance information and/or current exercise environment information, in addition to learning information on past exercise record information, in the analysis for running posture coaching.

In an embodiment, the learning and personalization engine 230 may perform real-time exercise analysis using real-time information. For example, the real-time information may include information on one or more of place, current location, running direction, weather, temperature, humidity, wind direction, wind strength, downhill development, uphill development, duration of exercise, average pace, average heart rate, exercise time (e.g., morning, lunch time, or evening), current pace, current heart rate, average current cadence (e.g., "spm"), degree of left-right asymmetry, ground contact time, flight time, regularity, vertical amplitude, stiffness, maximum oxygen rate (VO2Max), and blood oxygen saturation (SPO2).

In an embodiment, the learning and personalization engine 230 may determine whether or not exercise coaching is utilized in a specified situation and perform real-time exercise analysis according to the determined result. For example, the specified situation may be related to any one of the case in which the user moves a specified distance or more (e.g., 100 m, 200 may, etc.), the case in which a specified time has elapsed (e.g., 10 minutes, 20 minutes, 30 minutes, etc.), the case in which a large change is detected (e.g., if a change more than a threshold is detected based on any one of the pace, the heart rate, and the slope), the case in which a point is specified as utilizing exercise coaching, based on the analysis situation by ground states (e.g., flatland, uphill, or downhill) and past exercise records.

In an embodiment, the learning and personalization engine 230 may receive past exercise record information corresponding to current exercise environment information from the exercise record analysis engine 210 and receive a real-time exercise analysis result from the real-time exercise analysis engine 220. The learning and personalization engine 230 may produce exercise coaching information, based on the past exercise record information corresponding to the current exercise environment information and the real-time exercise analysis result. For example, the learning and personalization engine 230 may configure personalized feedback item information. For example, the personalized feedback item information may include information on at least one of precautions in the early stage, middle stage, and/or late stage of exercise according to posture analysis, precautions according to the temperature/humidity difference, and a recommended cadence or a recommended pace according to the wind direction/wind strength.

The learning and personalization engine 230 may transmit exercise coaching information to the exercise coaching engine 240 and/or the real-time exercise analysis engine 220.

In an embodiment, the learning and personalization engine 230 may determine whether or not exercise coaching is to be provided (or whether or not exercise coaching is possible), based on the personalized feedback item information. For example, in the case of irregular terrain (if the uphill and the downhill are repeated), exercise coaching may be determined to be provided. As another example, it may be determined whether or not exercise coaching is to be provided based on a user's running direction or weather.

When exercise coaching is to be provided, the learning and personalization engine 230 may transmit a request for exercise coaching to the exercise coaching engine 240.

In an embodiment, the exercise coaching engine 240 may provide a user interface related to exercise coaching information transmitted from the learning and personalization engine 230. For example, the exercise coaching engine 240 may serve to determine an appropriate output method of exercise coaching information and inform the user of exercise coaching information according to the determined output method.

In an embodiment, the exercise coaching engine 240 may provide pre-exercise feedback based on the personalized feedback item information received from the learning and personalization engine 230. For example, the pre-exercise feedback may be provided using one or more of text, images, or voices.

In an embodiment, the exercise coaching engine 240 may produce exercise coaching information. The exercise coaching engine 240 may provide a user interface related to the exercise coaching information.

For example, the exercise coaching engine 240 may provide pre-exercise feedback. For example, the exercise coaching engine 240 may produce pre-exercise coaching information, based on the personalized feedback item information received from the learning and personalization engine 230, and provide a user interface related to the pre-exercise coaching information.

As another example, the exercise coaching engine 240 may provide in-exercise coaching. For example, when exercise coaching is to be provided, the exercise coaching engine 240 may receive a request for in-exercise coaching from the learning and personalization engine 230 and provide in-exercise coaching in response to the request for in-exercise coaching. For example, the in-exercise feedback may be provided using one or more of a beep sound, text, images, vibration, voices, music tempo control, and volume control.

As another example, the exercise coaching engine 240 may provide post-exercise feedback. For example, the exercise coaching engine 240 may receive an overall analysis result of exercise from the exercise record analysis engine 210 after the exercise ends, and provide post-exercise feedback based on the analysis result. For example, the post-exercise feedback may be provided using one or more of text, images, and voices.

In an embodiment, past exercise record information may be stored in the exercise data storage 260. For example, the past exercise record information may include one or more pieces of basic exercise information (e.g., information about one or more of exercise type, frequency of exercise, a period, pace, heart rate, and time), exercise environment information (e.g., information about one or more of temperature, humidity, wind direction, wind strength, and terrain), exercise information according to goal setting, and exercise evaluation information (e.g., evaluation information about one or more of regularity, vertical amplitude, ground contact time, stiffness, and flight time). For example, the exercise environment information may be matched with at least one piece of basic exercise information, exercise information according to goal setting, and/or exercise evaluation information, and may then be stored as the past exercise record information.

In an embodiment, user profile information may be stored in the profile data storage 250. For example, the user profile information may include information about one or more of age, gender, health status, and an exercise goal set by the user.

Figure 3:
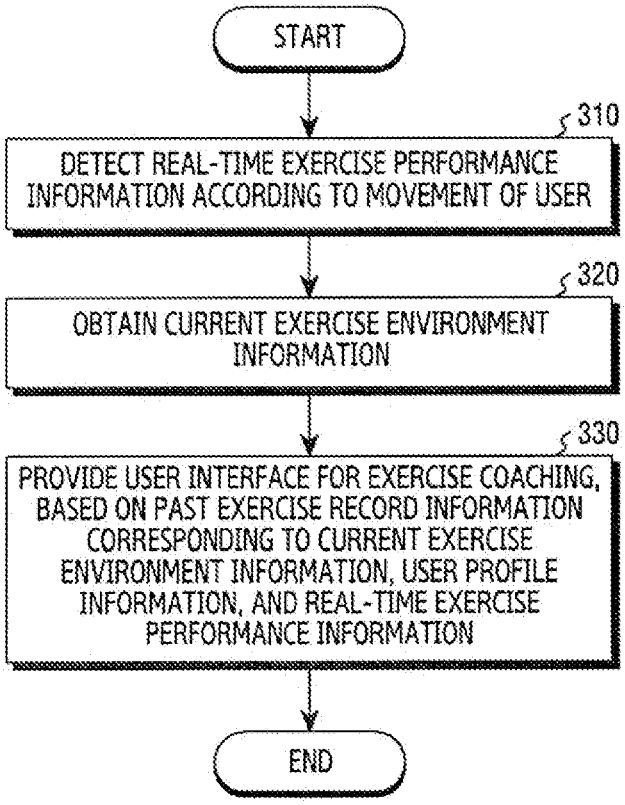
FIG. 3 is a flowchart illustrating an operating method of an electronic device according to an embodiment.

FIG. 3 is a flowchart illustrating an operating method of an electronic device according to an embodiment. For example, the method illustrated in FIG. 3 may correspond to a method for providing personalized exercise coaching (or guidance for performance of the exercise). The method in FIG. 3 may be performed by an electronic device (e.g., the electronic device 100 in FIG. 1, an application (e.g., a health application) executed in the processor 110 or the electronic device 100, or the personalized coaching engine 200 in FIG. 2). For convenience, although it is assumed that the method in FIG. 2 is performed by the electronic device 100, the disclosure is not limited thereto.

In operation 310, the electronic device 100 may detect real-time exercise performance information according to detected movement of the user.

For example, the real-time exercise performance information may include sensor-originated information about the performance of some exercise by the user. The information may include biometric information and/or motion information. The information may include any one of pace, distance, time, cadence, vertical movement, left-right motion, stride length, heart rate, and blood pressure. For example, the real-time exercise performance information may correspond to at least some of motion data output from the sensor module 140 (e.g., an acceleration sensor and/or a gyro sensor) of the electronic device 100 and biometric data output from the sensor module 140 (e.g., a biometric sensor).

In operation 320, the electronic device 100 may obtain current exercise environment information.

For example, the current exercise environment information may include information regarding a local environment or location at which the user is performing the exercise. The current exercise environment information may include one or more pieces of place/location information, weather situation information, and user situation information (e.g., information about the user, in the context of performing the exercise). For example, the place information may include information about one or more of a location and terrain (e.g., altitude, slope, uphill, downhill, and ground status). The weather situation information may include information about one or more of weather, temperature, humidity, wind direction, and wind strength. The user situation information may include information about one or more of an exercise direction (e.g., a direction to which the user is facing or traveling) and an exercise route (e.g., a route along which the user is jogging or riding a bike, etc.).

For example, the current exercise environment information may correspond to at least some of environmental data output from the sensor module 140 (e.g., an atmospheric-pressure sensor) of the electronic device 100, positioning data received through the communication circuit 130 (e.g., a GNSS communication module), and weather data received through the communication circuit 130 (e.g., a cellular communication module).

In operation 330, the electronic device 100 may provide (e.g., generate, output and/or transmit) a user interface including guidance in the form of algorithmic exercise coaching, based at least in part on past/historic exercise record information corresponding to a current location as indicated the current exercise environment information, profile information of the user, and/or real-time exercise performance information.

For example, the past exercise record information may be information corresponding to at least one of a place, a weather situation, and a user situation indicated by the current exercise environment information. For example, the user profile information may include information about one or more of age, gender, health status, and an exercise goal set by the user.

In an embodiment, the user interface for exercise coaching may be implemented as a visual type (e.g., screens or text), an auditory type (e.g., audio or sound), a tactile type (e.g., vibration), or a hybrid type by a combination of at least some thereof.

For example, the electronic device 100 may output a user interface for exercise coaching. The processor 110 may output a user interface of a visual type, an auditory type, a tactile type, or a hybrid type to the user through the output module 150.

As another example, the electronic device 100 may transmit information about the user interface to one or more external electronic devices, thereby outputting the user interface (e.g., screens, text, voices, or vibration) through the external electronic device.

In an embodiment, when providing exercise coaching based on the current exercise environment information, the electronic device 100 may provide exercise coaching for different exercise zones (e.g., places or locations).

As an example, operation 330 of providing a user interface for exercise coaching may include obtaining past exercise record information corresponding to a current zone, based on the current exercise environment information, and providing a user interface for exercise coaching for the current zone, based on the past exercise record information.

As another example, operation 330 of providing a user interface for exercise coaching may include obtaining past exercise record information corresponding to the current zone and the next zone of the current zone, based on the current exercise environment information, and providing a user interface for exercise coaching for the next zone, based on the past exercise record information.

As another example, operation 330 of providing a user interface for exercise coaching may include obtaining past exercise record information for the entire exercise zone including the current zone, based on the current exercise environment information, and providing a user interface for exercise coaching for each of a plurality of zones in the entire exercise zone, based on the past exercise record information.

In an embodiment, the operating method of the electronic device 100 may further include determining a zone, among the entire exercise zone including a warm-up zone, a main exercise zone, and a cool-down zone, to which the current zone belongs based on the real-time exercise performance information. The electronic device 100 may provide a user interface for exercise coaching by further considering the zone to which the current zone belongs.

In an embodiment, the operating method of the electronic device 100 may further include determining the current state to be one of a pre-exercise state, an in-exercise state, and a post-exercise state, based on the real-time exercise performance information. The electronic device 100 may provide a user interface for exercise coaching by further considering the state corresponding to the current state.

For example, a user interface for personalized exercise coaching may be provided through the electronic device 100 or an external electronic device connected to the electronic device 100 through short-range wireless communication. FIGS. 7A, 7B, 8A, 8B, 8C, 8D, 9, 10A, 10B, 11, 12, 13A, 13B, 14A, 14B, 14C, 15, and 16, which will be described later, illustrate user interfaces that may be provided in various embodiments.

Figure 4:
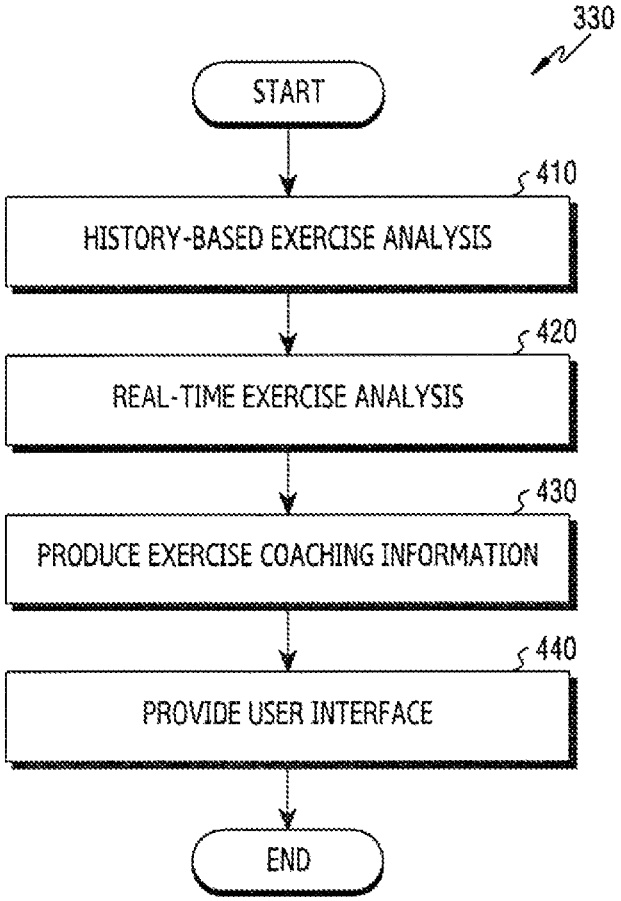
FIG. 4 is a flowchart illustrating a part of an operating method of the electronic device shown in FIG. 3.

FIG. 4 is a flowchart illustrating a part of an operating method of the electronic device shown in FIG. 3. For example, operation 330 in FIG. 3 may include operations 410, 420, 430, and 440 illustrated in FIG. 4.

In operation 410, an electronic device 100 (e.g., the exercise record analysis engine 210) may perform a history-based exercise analysis.

History-based motion analysis operations may be described through the following example.

According to an embodiment, the exercise record analysis engine 210 may analyze "basic" exercise information and provide an analysis result thereof. For example, the basic exercise information may be analyzed to indicate frequency of exercise (e.g., two or more times per week), time/pace/heart rate for the exercise session (e.g., a run that lasted 5 minutes or more at 6 km/h or more), and/or an exercise period (e.g., data within 2 weeks from the last exercise is used). The exercise record analysis engine 210 may analyze irregularities or problems in the exercise, such as a case in which the degree of left-right asymmetry is severe, or where regularity is low. Further, additional information, such as past injury experiences or injuries during exercise may be inferred or input and applied to coaching.

According to an embodiment, the exercise record analysis engine 210 may analyze exercise environment information and provide an analysis result thereof. For example, the place (e.g., terrain) where the user runs and weather situations (e.g., weather) are closely related to running posture and maintaining physical strength, so coaching using simple basic exercise information such as pace/distance/tempo may be difficult to obtain the highest level of satisfaction from the user.

In an embodiment, the user's exercise environment information may be utilized to maximize coaching satisfaction.

For example, the exercise record analysis engine 210 may provide past exercise record information according to the specified criteria below to the learning and personalization engine 230, and the learning and personalization engine 230 may collect past exercise record information according to the criteria and support use of the same in coaching.

For example, the exercise environment information may include place information. The place information may include information about at least one of an exercise route/movement direction/terrain (e.g., degree of slope). As an example, if the exercise route matches based on the frequency, the corresponding place information may be utilized as the exercise route and used in coaching. As another example, the past exercise record information corresponding to the current location information and a radius of about 10 m may be provided.

For example, the exercise environment information may include weather information. The weather information may include information on at least one of temperature/humidity/wind direction/wind strength.

For example, based on the frequency and duration, weather information recorded for a recently performed exercise may be provided and utilized in coaching.

As another example, information about at least one of temperature/humidity/wind direction/wind strength for the current location may be provided and utilized in coaching.

As another example, place information (e.g., exercise location, exercise route, direction, and degree of slope) may be provided and utilized in coaching. For example, most users may perform an exercise at the same place in a similar route. If the location in the past exercise record is similar to the current exercise location, location-based coaching may be provided when the user starts an exercise. For example, an exercise result for the location of the past exercise record and the current exercise location may be determined, and a summary of precautions or good things in the early/middle/late stages of exercise, thereby reducing the possibility of injury of the user or increasing the efficiency of exercise. For example, if the initial evaluation is not good even for the exercise in the flat place, the user may be recommended to warm up.

In the case of exercising in a new location, the past terrain information similar thereto may be primarily used if there is a record thereof, otherwise coaching utilizing terrain information may not be provided because the coaching may be wrong. The similar terrain above may indicate the degree of slope and a zone shape (e.g., a curved shape or a straight shape).

According to an embodiment, the exercise record analysis engine 210 may analyze exercise information according to goal setting and provide an analysis result thereof. For example, the exercise record analysis engine 210 may classify running into three types, analyze additional information to the existing analysis during a warm-up period, and use the same in real-time coaching. In this case, information such as a place, a route, weather, and a wind direction may be utilized for coaching in consideration of the exercise environment of the user.

For example, in the case where an exercise includes a warm-up period, a main exercise period, and a cool-down period, or in the case of using a pace setter function, if a first target condition (e.g., 5 minutes and an average pace of about 4 km/h) is satisfied, it may be determined as a warm-up period. For example, during the warm-up period, the degree of left-right asymmetry and regularity may be analyzed at a distance of about 100 m or more after the start of exercise, thereby utilizing the analysis result thereof in coaching. If a second target condition according to an exercise time, an exercise distance, and/or an exercise pace (maintaining a predetermined pace or more) is satisfied, it may be determined as a main exercise period. During the main exercise period, the degree of left-right asymmetry, regularity, ground contact time, flight time, vertical amplitude, and/or stiffness may be analyzed, thereby utilizing the analysis result thereof in coaching. If a third target condition (e.g., 5 minutes and an average pace of about 3.5 km/h) is satisfied, it may be determined as a cool-down period. During the cool-down period, voice coaching may not be provided or may not be used as analysis information.

For example, in the case of an exercise that does not use a pace setter function, it may be determined to a main exercise without warm-up, thereby performing analysis and/or real-time coaching. For example, the degree of left-right asymmetry and regularity may be analyzed at a predetermined distance (e.g., 100 m) or more after the start of exercise, thereby utilizing the analysis result thereof in coaching. As another example, if the current pace belongs to the average pace of the user for the last two weeks, the current pace may be used in real-time exercise posture analysis.

According to an embodiment, the exercise record analysis engine 210 may analyze exercise evaluation information and provide an analysis result thereof.

In operation 420, the electronic device 100 (e.g., the real-time exercise analysis engine 220) may perform a real-time exercise analysis.

In operation 430, the electronic device 100 (e.g., the learning and personalization engine 230) may produce exercise coaching information. For example, based on the analysis from operations 410 and 420, the electronic device 100 may generate prompts and guidance which may improve the quality of the performance of the exercise.

According to an embodiment, the learning and personalization engine 230 may generate guidance that is directed to correcting an exercise posture (e.g., a running posture), for an exercise.

An input of evaluation information for each exercise zone or each exercise time is received from the exercise record analysis engine 210, and the information may be analyzed so that an optimized coaching providing method (or a format for provision of the coaching guidance) according to the past exercise of the user may be transmitted to the exercise coaching engine 240. The learning and personalization engine 230 may transmit information to be considered during exercise to the exercise coaching engine 240 and the real-time exercise analysis engine 220 to support additional analysis.

Input information of the learning and personalization engine 230 may include evaluation information for each exercise zone and/or evaluation information for each exercise time.

Output information of the learning and personalization engine 230 may include information about coaching items and/or coaching content.

The output information of the learning and personalization engine 230 may include information about coaching items before/during/after exercise. The corresponding information may be transmitted to the exercise coaching engine 240. For example, summary information about precautions or good things in the early/middle/late stages of exercise may be transmitted. For example, at the beginning of the exercise, a coaching message "You moved your upper body too much at a specific time (x km point/time/location POI (point-of-interest)) during the previous exercise. Please try to move lightly." may be provided through a screen or a voice. As another example, at the beginning of the exercise, based on the average vertical amplitude of the previous exercise (e.g., if it is 7 cm), if the average vertical amplitude approaches about 7 cm during exercise, a coaching message "You move up and down too much. Please keep your upper body balanced by adjusting your pace and stride." may be provided through a screen or a voice.

The output information of the learning and personalization engine 230 may include information about content to be considered during exercise. The corresponding information may be transmitted to the exercise coaching engine 240 and the real-time exercise analysis engine 220.

For example, the content to be considered during exercise may include a coaching priority depending on an individual running skill of the user. For example, exercise coaching may be provided to a first user who is a beginner in order to reduce injury and focus on improving the degree of left-right asymmetry and regularity during running. As another example, exercise coaching may be provided to a second user in an intermediate level in order to provide exercise analysis results stating that exercise regularity is delayed and the vertical amplitude increases after a specified point (e.g., the point of 7 km), and focus on reduction of fatigue and efficient running.

In an embodiment, the learning and personalization engine 230 may determine the individual running skill in determining the priority for coaching, analyze the content to be considered during exercise according to the running skill, and provide exercise coaching information according to the analysis result.

For example, the running skill may be any one of a beginner level (e.g., running about 5 km or less at a time within the last month (an average pace of about 7 to 9 km)), an intermediate level (e.g., running about 10 km or more at a time within the last month) (average pace: about 10 km) or running about 5 km or more at a time within the last month (an average pace of about 12 km or more)), an advanced level (e.g., running about 20 km or more at a time within the last month (average pace: about 10 km or more) or running about 10 km or more at a time within the last month (average pace: about 12 km or more)), and the highest level (running about 30 km or more at a time within the last month (average pace: about 12 km or more) or running about 15 km or more at a time within the last month (average pace: about 14 km or more)).

In operation 440, the electronic device 100 (e.g., the exercise coaching engine 240) may generate and output (e.g., provide) a user interface for exercise coaching, based on the generated prompts, guidance, etc. of the coaching information.

Figure 5:
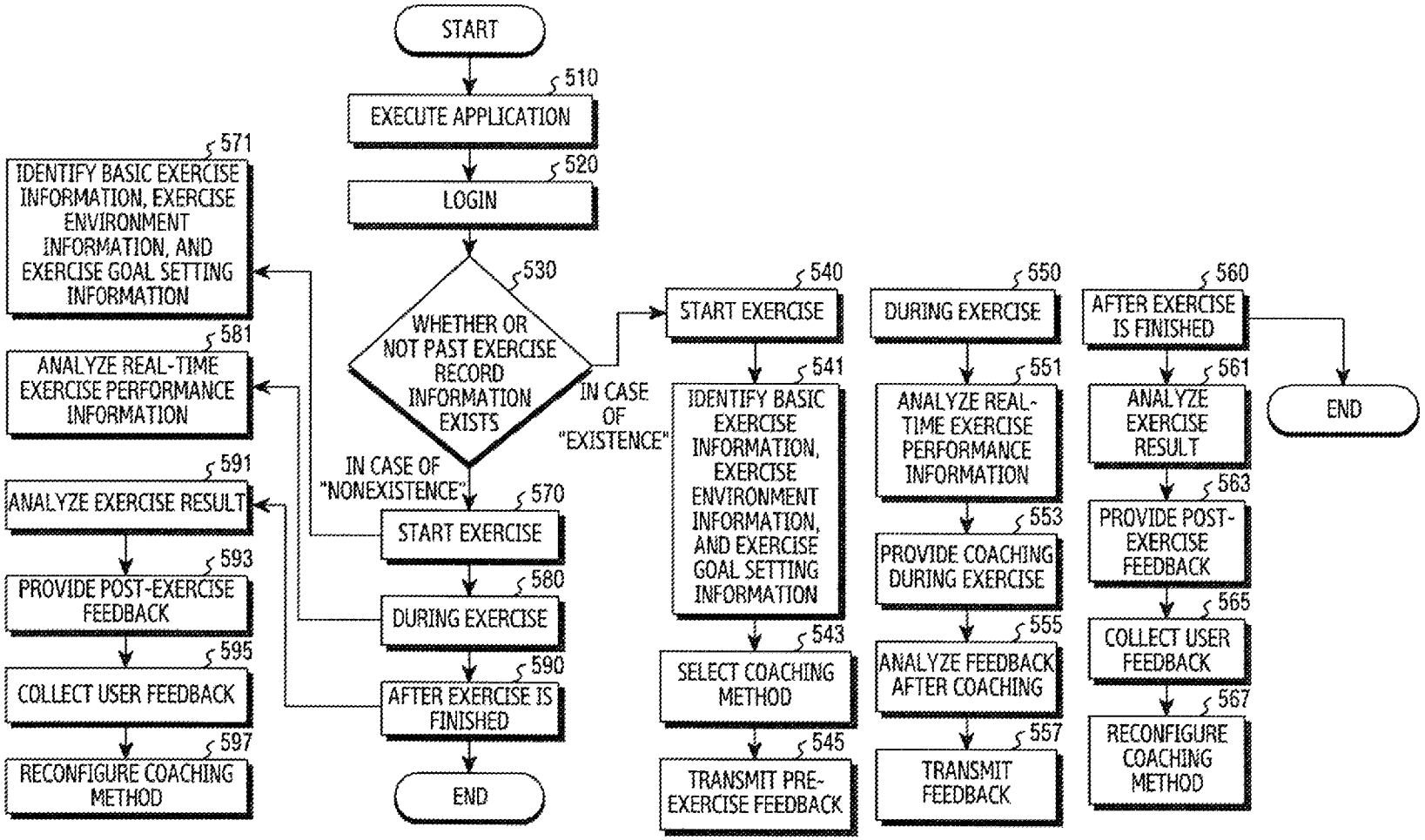
FIG. 5 is a flowchart illustrating an operating method of an electronic device according to another embodiment.

FIG. 5 is a flowchart illustrating an operating method of an electronic device according to another embodiment. For example, the operating method of the electronic device illustrated in FIG. 5 may correspond to a method for providing personalized exercise coaching depending on the existence of a past exercise record. The method in FIG. 5 may be performed by an electronic device (e.g., the electronic device 100 in FIG. 1, an application (e.g., a health application) executed in the processor 110 or the electronic device 100, or the personalized coaching engine 200 in FIG. 2). For convenience, although it is assumed that the method in FIG. 5 is performed by the electronic device 100, the disclosure is not limited thereto.

In operation 510, an application (e.g., a health application) for providing a personalized exercise coaching function may be executed in the electronic device 100.

In operation 520, a user login process may be executed in the electronic device 100. For example, the electronic device 100 may authenticate personal identification information such as an ID, a biometric ID, a phone number, an email address, a password, and a security pattern, thereby performing user login. As the user login is performed, application-related information of the user having logged in may be loaded from an external electronic device (e.g., the server 1708 in FIG. 17) so that an execution screen of the corresponding application may be displayed through a screen of the electronic device 100.

In operation 530, the electronic device 100 may identify whether or not a past/historic exercise record exists for the user that is logged in. For example, past exercise record information may not exist where, for example, the application was only recently installed, where the application is reset, or where data has not yet been accumulated for a sufficient predetermined period, or for longer than an initial installation stage.

As a result of the determination in operation 530, if there is past exercise record information, the process may continue to operation 540.

Operation 540 may include execution of a coaching operation when exercise is initiated. Operation 540 may include operations 541, 543, and 545. In operation 541, the electronic device 100 may identify at least some of the user's "basic" exercise information (e.g., as referenced above), information on an environment in which the exercise is performed (e.g., exercise environment information), and any stored user goals for exercise (e.g., exercise goal setting information), which will be used for analysis. In operation 543, the electronic device 100 may select a format for provision of the coaching guidance (e.g., a coaching providing method). In operation 545, the electronic device 100 may transmit pre-exercise feedback based on at least some of the basic exercise information, the exercise environment information, and the exercise goal setting information.

Operation 550 may be a coaching operation that is executed during the user's performance of the exercise. Operation 550 may include operations 551, 553, 555, and 557. In operation 551, the electronic device 100 may analyze real-time exercise performance information. For example, the electronic device 100 may analyze real-time exercise performance information, based on past exercise record information corresponding to the current exercise environment information. In operation 553, the electronic device 100 may provide coaching during exercise to the user. In operation 555, the electronic device 100 may analyze user feedback after coaching. In operation 557, the electronic device 100 may transmit the user feedback (e.g., transmits the same from the exercise coaching engine 240 to the learning and personalization engine 230) to reconfigure the exercise coaching information (e.g., the personalized feedback item information).

Operation 560 may be a coaching operation after the exercise is finished. Operation 560 may include operations 561, 563, 565, and 567. In operation 561, the electronic device 100 may analyze an exercise result. In operation 563, the electronic device 100 may provide post-exercise feedback based on the analysis of the exercise result. In operation 565, the electronic device 100 may collect user feedback. For example, user feedback related to one or more of satisfaction, fatigue, and achievement of goals may be collected. In operation 567, the electronic device 100 may reconfigure a coaching providing method (or a format of guidance) optimized for the user by reflecting the user feedback.

If it is determined that no past/historic exercise record information exists in operation 530, operation 570 may be performed.

Operation 570 may include operations of a coaching operation at the initiation of exercise. Operation 570 may include operation 571. In operation 571, the electronic device 100 may identify at least some of the user's "basic" exercise information, exercise environment information, and exercise goal setting information used for analysis. Operation 571 may be repeatedly or periodically performed after the initiation of exercise in operation 570.

Operation 580 may include operations for provision of coaching during user performance of exercise. Operation 580 may include operation 581. In operation 581, the electronic device 100 may analyze real-time exercise performance information generated by the user's performance of exercise. For example, the electronic device 100 may analyze real-time exercise performance information based on past exercise record information, corresponding to the current exercise environment information. Operation 581 may be repeatedly or periodically performed during exercise in operation 580.

Operation 590 may include a coaching operation that is executed after the performance of the exercise is finished. Operation 590 may include operations 591, 593, 595, and 597. In operation 591, the electronic device 100 may analyze results of the performed exercise. In operation 593, the electronic device 100 may provide post-exercise feedback based on the analysis of the exercise result. In operation 595, the electronic device 100 may receive user feedback on the performed exercise and/or the coaching operation. For example, user feedback related to one or more of satisfaction, fatigue, and achievement of goals may be collected. In operation 597, the electronic device 100 may reconfigure the provision of coaching, to improve optimization for the user, based in part on the user feedback.

Various embodiments will be described based on a running exercise by way of example in the following drawings. However, the exercise targeted for exercise coaching is not necessarily limited thereto, and change, modification, application, or expansion to other types of exercise may be possible. For example, exercise coaching may be provided for various types of exercises such as an exercise with regularity, an exercise that partially includes running, an exercise of walking at a certain pace or more, an exercise that lasts for a certain time or more, and an exercise in which running and walking are mixed.

Figure 6:
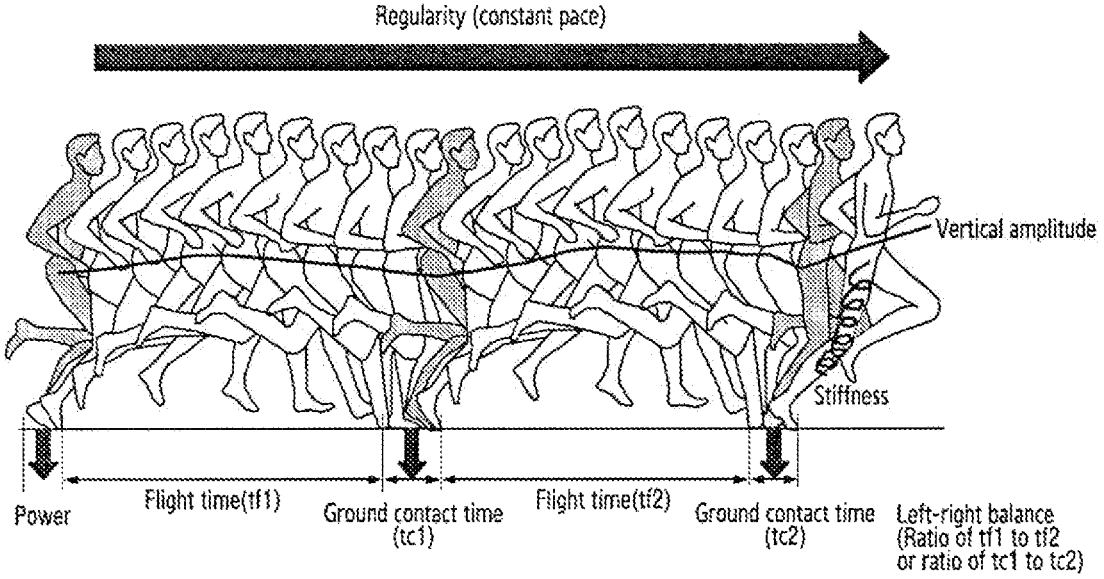
FIG. 6 is a reference diagram illustrating a running exercise coaching function applicable to an electronic device according to an embodiment.

FIG. 6 is a reference diagram illustrating a running exercise coaching function applicable to an electronic device according to an embodiment.

In an embodiment, the exercise for which coaching will be provided may be running. The user interface provided through the electronic device 100 may be intended for running-related coaching. For example, the user interface may be related to information about one or more of the degree of left-right asymmetry, flight time, ground contact time, stiffness, vertical amplitude, and regularity according to running posture evaluation items.

As an example, the electronic device 100 may provide coaching after exercise. The electronic device 100 may provide (e.g., display on a screen) a user interface for running posture evaluation items after the user finishes the running exercise. The running posture evaluation items may include a result of analyzing the user's running posture, based on a specified set of running posture evaluation items. For example, the specified set of running posture evaluation items may include at least some of the degree of left-right asymmetry (or left-right balance), ground contact time, flight time, regularity (or constant pace), or vertical amplitude, and stiffness. The degree of left-right asymmetry (or left-right balance) may be calculated using the ratio of a first flight time tf1 to a second flight time tf2 or the ratio of a first ground contact time tc1 to a second ground contact time tc2.

As another example, the electronic device 100 may provide coaching during exercise. The electronic device 100 may provide a user interface (e.g., output by a voice) informing of information such as a running pace, a running distance, and a user's heart rate during the running exercise of the user.

FIGS. 7A to 13B below show various user interfaces related to personalized exercise coaching by way of example. For example, the user interface according to various embodiments may include one or more of the screens shown in FIGS. 7A to 13B. For example, the screens shown in FIGS. 7A to 13B may be app execution screens display through an application (e.g., a health application) that is running in the electronic device 100 or an app (e.g., a health application) that is running in an external electronic device connected to the electronic device 100 through short-range wireless communication.

Figure 7A:
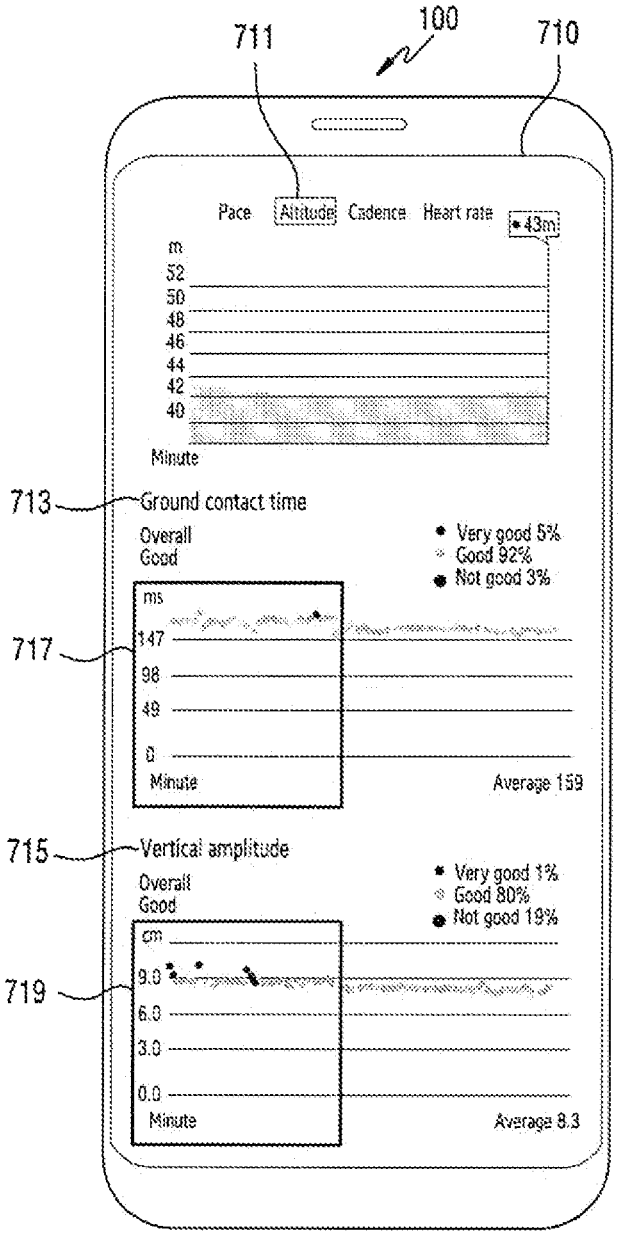
FIG. 7A illustrates an example of a user interface related to exercise coaching based on a location in a current exercise environment in an electronic device according to an embodiment.
Figure 7B:
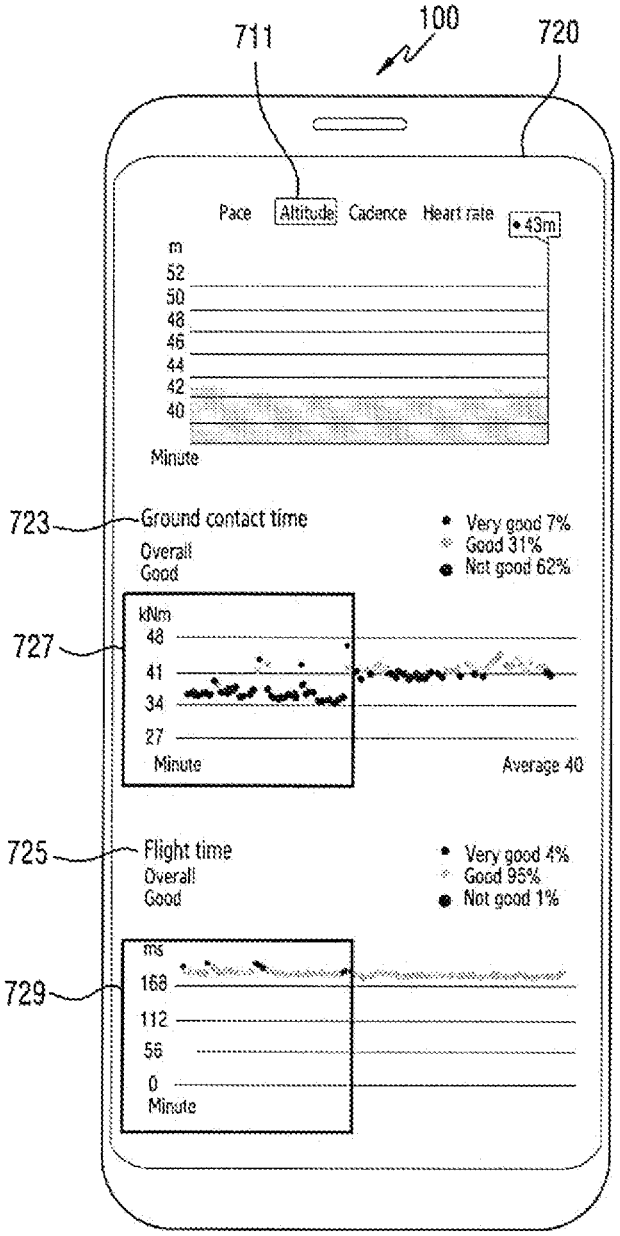
FIG. 7B illustrates another example of a user interface related to exercise coaching based on a location in a current exercise environment in an electronic device according to an embodiment.

FIG. 7A illustrates an example of a user interface related to provision of exercise coaching, based on a location indicated by a current exercise environment, in an electronic device according to an embodiment. FIG. 7B illustrates another example of a user interface related to exercise coaching based on a location in a current exercise environment in an electronic device according to an embodiment.

In FIG. 7A, reference numeral 710 denotes a first screen. The first screen 710 may include display running posture evaluation items (e.g., changes in the ground contact time 713 and the vertical amplitude 715 with time) with respect to an altitude 711.

In FIG. 7B, reference numeral 720 denotes a second screen. The second screen 720 may display running posture evaluation items (e.g., changes in the stiffness 723 and the flight time 725 with time) based on the altitude 711.

For example, a user interface such as the first screen 710 in FIG. 7A or the second screen 720 in FIG. 7B may be provided by exercise analysis in consideration of a place (e.g., location and altitude) among the current exercise environment information.

When the user initiates an exercise at a specified location, the electronic device 100 may identify that the evaluation is relatively poor in the periods 717, 719, 727, and 729 (for both FIGS. 7A-7B) at the start of exercise, even within a relative flat locale with little change in altitude along the running path, as derived from past exercise record information corresponding to the specified location. The electronic device 100 may display a user interface such as the first screen 710 or the second screen 720 in order to notify the user of such evaluation, or provide a user interface that recommends warming up (e.g., may provide text, a video, and a voice for a warm-up guide).

Figure 8A:
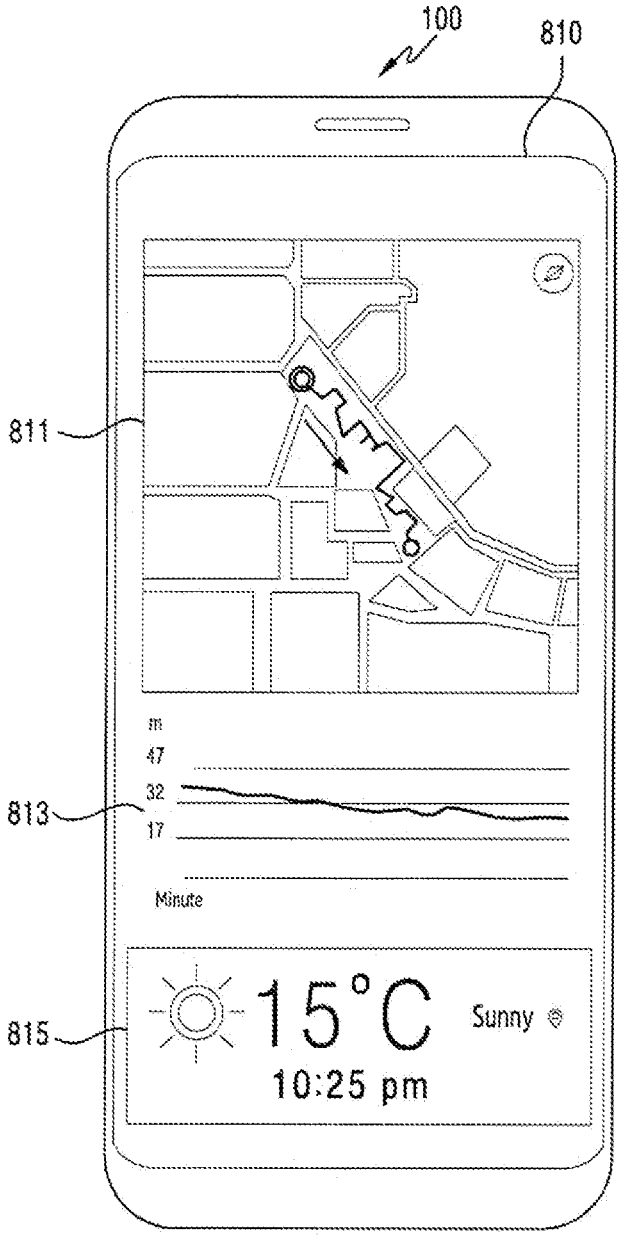
FIG. 8A illustrates an example of a user interface related to exercise coaching in the case where a current exercise environment is a downhill terrain in an electronic device according to an embodiment.
Figure 8B:
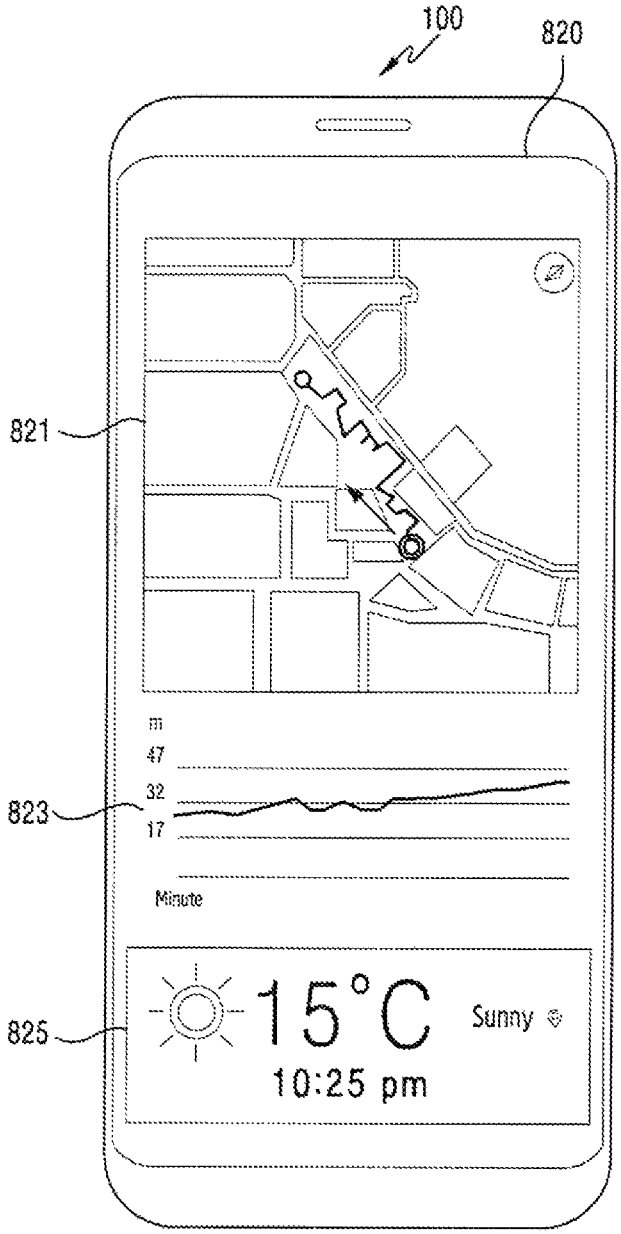
FIG. 8B illustrates an example of a user interface related to exercise coaching in the case where a current exercise environment is an uphill terrain in an electronic device according to an embodiment.

FIG. 8A illustrates an example of a user interface related to provision of exercise coaching in a situation where an exercise environment includes downhill terrain, in an electronic device according to an embodiment. FIG. 8B illustrates an example of a user interface related to exercise coaching in the case where an exercise environment is an uphill terrain in an electronic device according to an embodiment.

In FIG. 8A, reference numeral 810 denotes a first screen. The first screen 810 may include running posture evaluation items, including downhill terrain, altitude, and weather. The first screen 810 may include an area 811 indicating that the current terrain is downhill, an area 813 indicating a decrease in altitude with the exercise time, and an area 815 indicating the current weather.

In FIG. 8B, reference numeral 820 denotes a second screen. The second screen 820 may show running posture evaluation items including uphill terrain, altitude, and weather. The second screen 820 may include an area 821 indicating the current terrain is uphill, an area 823 indicating an increase in altitude with the exercise time, and an area 825 indicating the current weather.

For example, a user interface such as the first screen 810 in FIG. 8A or the second screen 820 in FIG. 8B may be provided through exercise analysis in consideration of a place (e.g., downhill terrain or uphill terrain) of the current exercise environment information.

The electronic device 100 may analyze past exercise record information in consideration of downhill terrain or uphill terrain.

For example, in the case where analysis is conducted based on an average value (e.g., the average running pace of a user), which is one item of the real-time exercise performance information, simple coaching may be possible to maintain the pace, reduce the pace, or increase the pace according to the difference between the average value and a target value. On the other hand, if the current exercise environment information is considered, it is possible to reduce the possibility of inappropriate coaching or incorrect coaching that does not match the current exercise environment, thereby increasing the exercise effect.

As exercise analysis is performed in consideration of the current exercise environment information, different analysis results and/or coaching may be provided even if the real-time exercise performance information (e.g., pace) is the same.

As an example, the electronic device 100 may perform exercise analysis in consideration of whether the user is exercising in downhill or uphill terrain. For example, even with the same average running pace, coaching may be provided to slow down the pace for the user's safety according to the user profile information (e.g., safety first) in the case of downhill terrain, and coaching may be provided to control the pace or power depending on the user profile information (e.g., stamina) in the case of uphill terrain.

As another example, the electronic device 100 may perform exercise analysis in consideration of both terrain and weather.

Figure 8C:
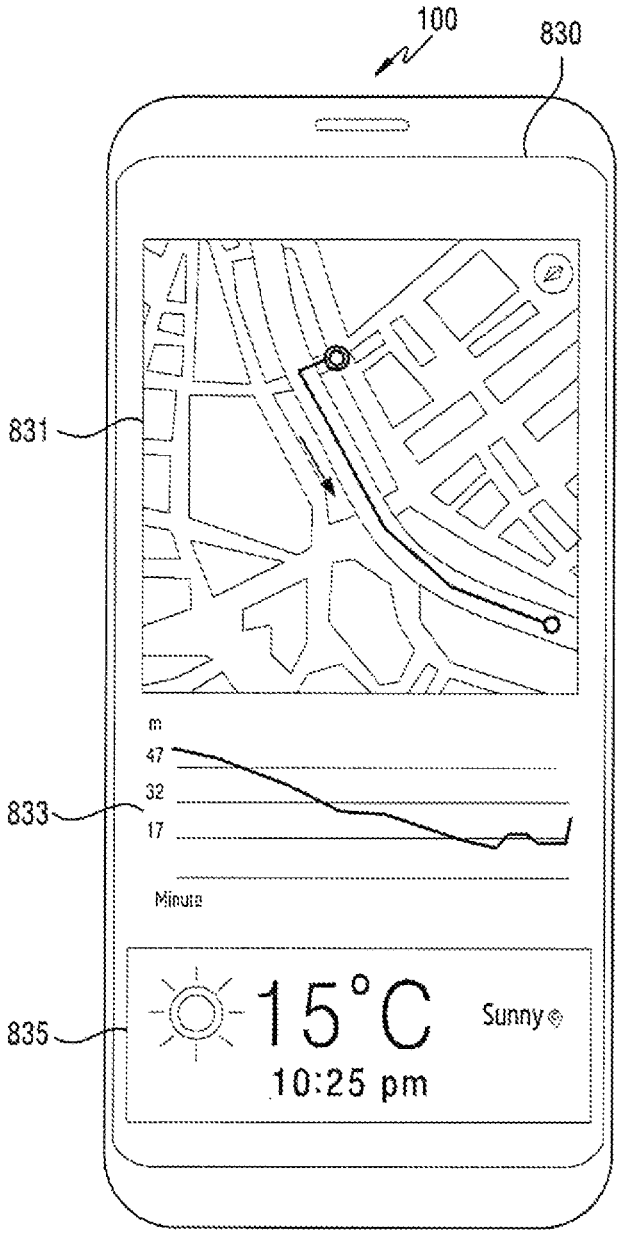
FIG. 8C illustrates an example of a user interface related to exercise coaching in the case where a running direction is a first direction in a current exercise environment in an electronic device according to an embodiment.
Figure 8D:
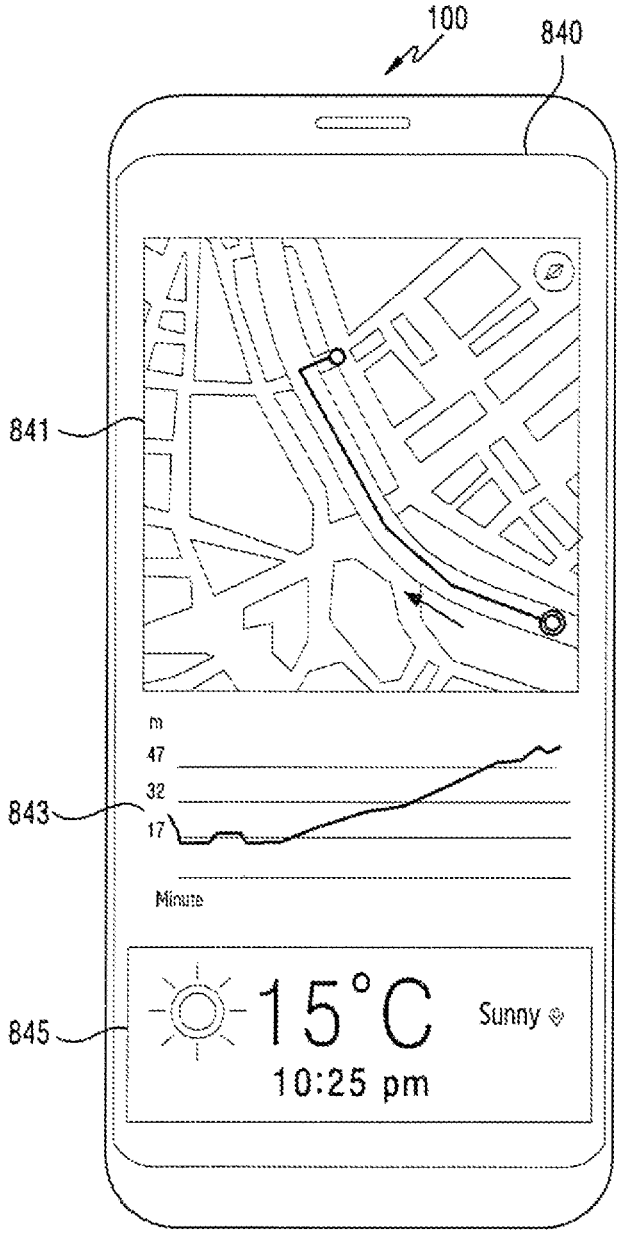
FIG. 8D illustrates an example of a user interface related to exercise coaching in the case where a running direction is a second direction in a current exercise environment in an electronic device according to an embodiment.

FIG. 8C illustrates an example of a user interface related to providing exercise coaching in a case where a running direction is a first direction, within a current exercise environment, for an electronic device according to an embodiment. FIG. 8D illustrates an example of a user interface related to exercise coaching in the case where a running direction is a second direction in a current exercise environment in an electronic device according to an embodiment.

For example, a user interface such as a third screen 830 in FIG. 8C or a fourth screen 840 in FIG. 8D may be provided through analysis in consideration of an exercise direction (e.g., a running direction) among the current exercise environment information.

In FIG. 8C, reference numeral 830 denotes a third screen. The third screen 830 may show running posture evaluation items reflecting running direction, altitude, and weather. The third screen 830 may include an area 831 indicating that the current running direction is a first direction, an area 833 indicating a change in altitude (downhill terrain) depending on the exercise time, and an area 835 indicating the current weather.

In FIG. 8D, reference numeral 840 denotes a fourth screen. The fourth screen 840 may illustrate running posture evaluation items including a running direction, altitude, and weather. The fourth screen 840 may include an area 841 indicating that the current running direction is a second direction, an area 843 indicating a change in altitude (uphill terrain) depending on the exercise time, and an area 845 indicating the current weather.

The electronic device 100 may perform exercise analysis in consideration of a running direction among the current exercise environment information. For example, information to be used for analysis may be specified from the current exercise environment information depending on an exercise type. For example, in the case of performing a running exercise, the running direction may be important information. The running directions may result in different exercise analysis results, and different coaching may be generated and provided according to the corresponding exercise analysis results. For example, even with the same average running pace, different types of coaching may be provided depending on the running direction (e.g., in view of terrain, direction may distinguish between running uphill or downhill, resulting in different recommendations increasing or reducing the pace).

Figure 9:
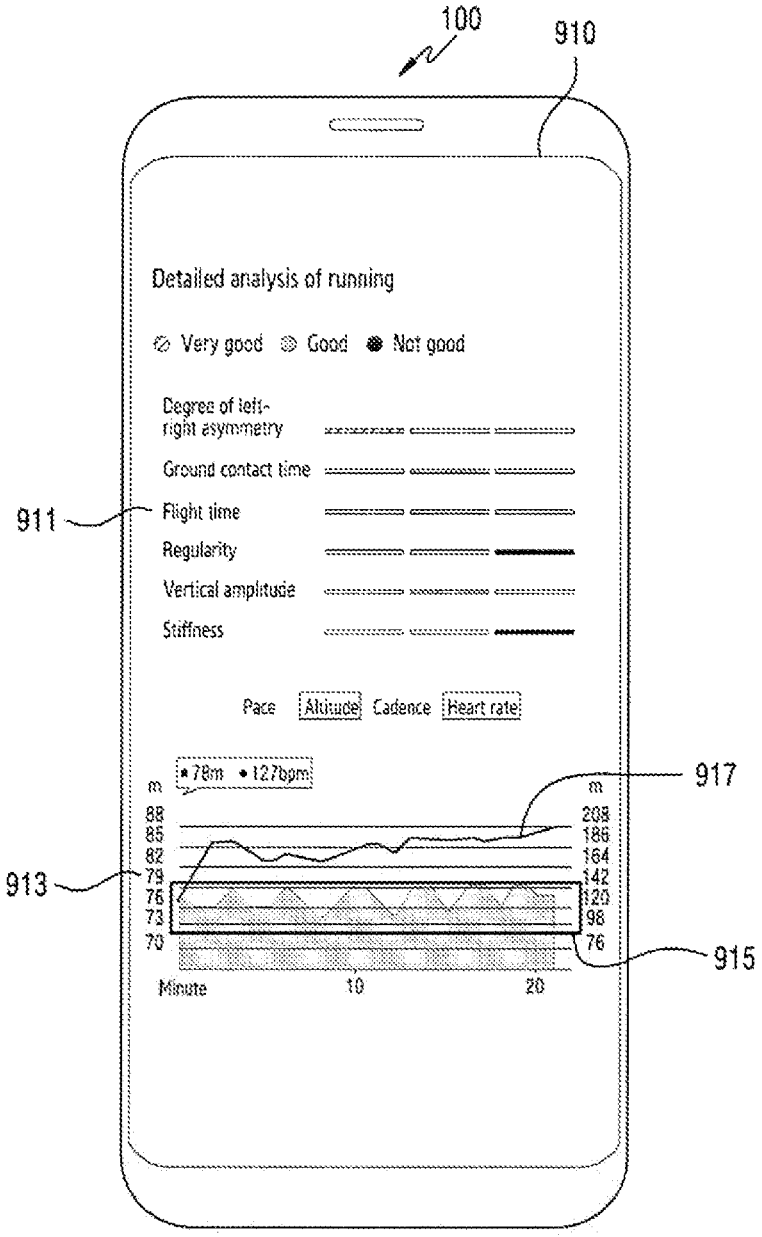
FIG. 9 illustrates an example of a user interface related to running posture evaluation items in an electronic device according to an embodiment.

FIG. 9 illustrates an example of a user interface related to running posture evaluation items in an electronic device according to an embodiment.

For example, a user interface such as the screen 910 in FIG. 9 may be provided according to running posture evaluation items based on current exercise environment information.

The screen 910 in FIG. 9 may include a first area 911 and a second area 913. A running posture comprehensive evaluation result may be displayed in the first area 911. A past altitude record 915 with the exercise time and a past heart rate record 917 with the exercise time may be displayed in the second area 913. The past altitude record 915 and the past heart rate record 917 displayed in the second area 913 may be examples of past, historic exercise record information that corresponds in some way to current exercise environment information (e.g., via a matching location or place).

The electronic device 100 may analyze a user's running exercise, based on a set of running posture evaluation items (e.g., at least some of the degree of left-right asymmetry, ground contact time, flight time, regularity, vertical amplitude, and stiffness), and display running posture evaluation items in the first area 911.

The electronic device 100 may display the past altitude record 915 and the past heart rate record 917 among past exercise records corresponding to the current place in the second area 913.

The electronic device 100 may provide exercise coaching according to the running posture evaluation items in the first area 911 and the past exercise records in the second area 913.

For example, referring to the running posture evaluation items in the first area 911, it can be seen that the regularity and stiffness of the user are evaluated as being "not good". Referring to the past altitude record 915 in the second area 913, it can be seen that the user has exercised on the irregular ground. Referring to the past heart rate record 917, it can be seen that the heart rate change is very irregular, although it has not been evaluated as being "not good". Summarizing these phenomena, the user may not intentionally exercise in the corresponding place, or the corresponding place may be very inappropriate for exercise.

The electronic device 100 may exclude a zone in which the corresponding phenomenon appears from analysis or apply a downscaled weight thereto.

Figure 10A:
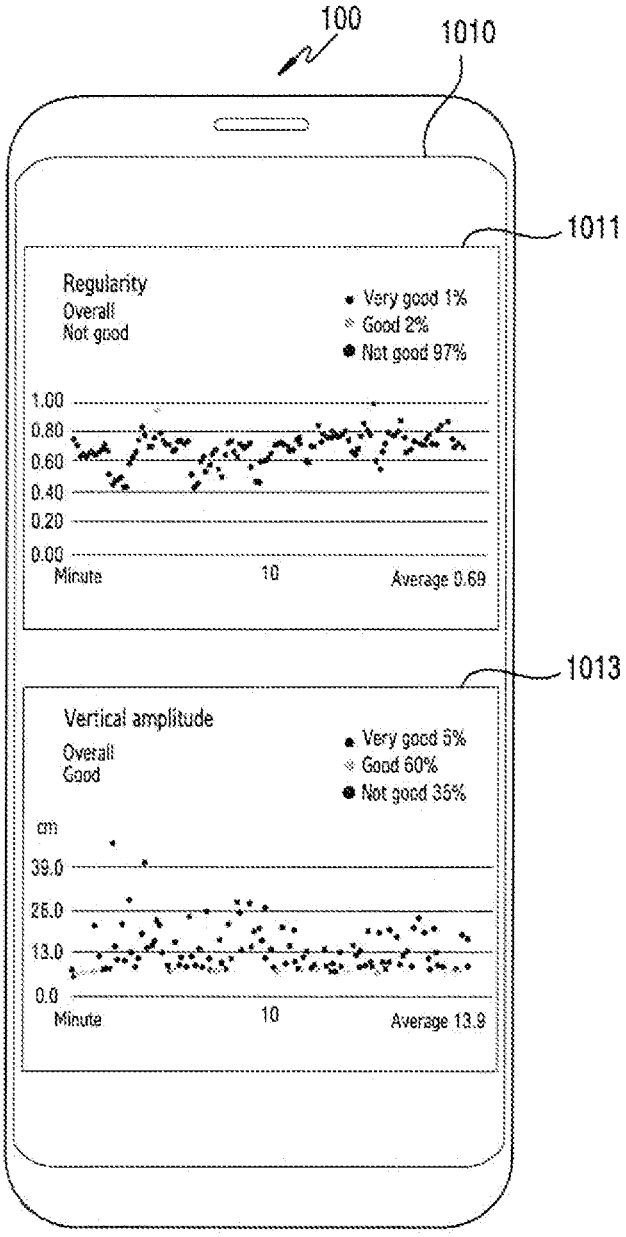
FIG. 10A illustrates an example of a user interface related to running posture evaluation items in an electronic device according to an embodiment.
Figure 10B:
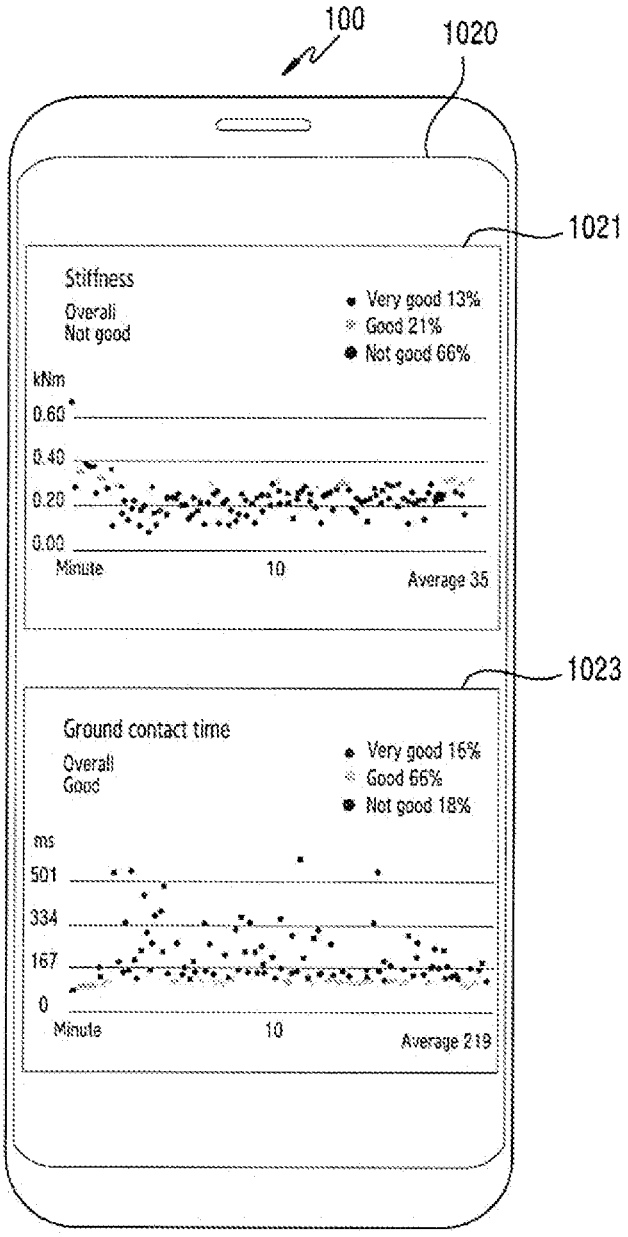
FIG. 10B illustrates another example of a user interface related to running posture evaluation items in an electronic device according to an embodiment.
Figure 11:
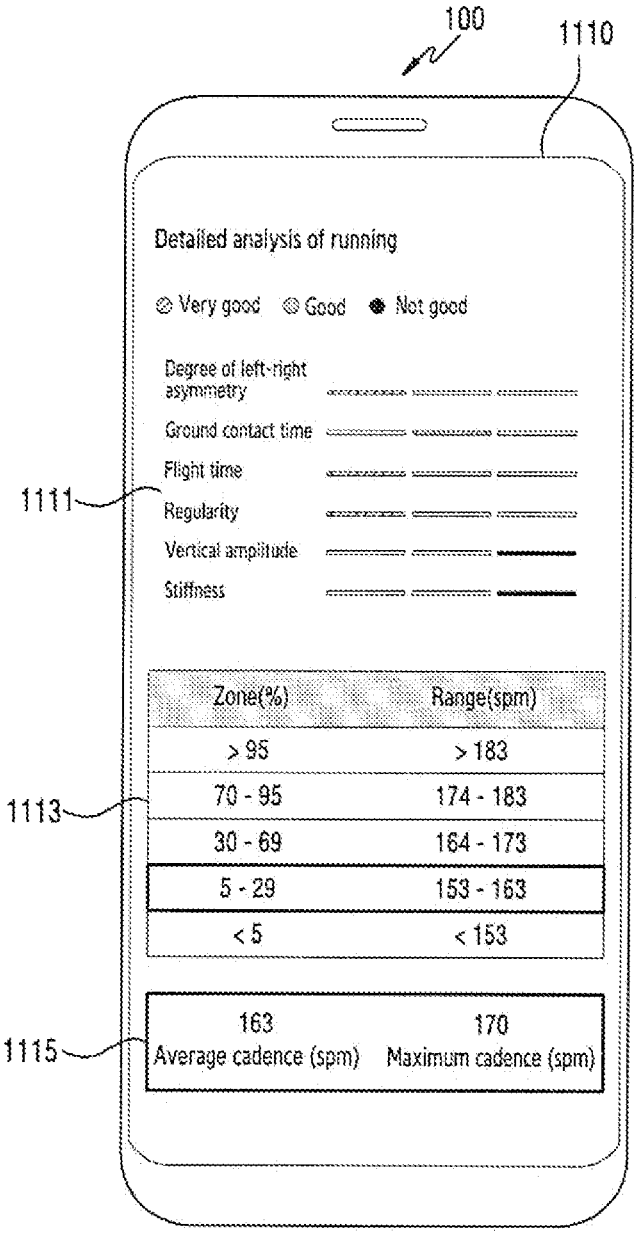
FIG. 11 illustrates another example of a user interface related to a running exercise analysis result in an electronic device according to an embodiment.

FIG. 10A illustrates an example of a user interface related to running posture evaluation items in an electronic device according to an embodiment. FIG. 10B illustrates another example of a user interface related to running posture evaluation items in an electronic device according to an embodiment. FIG. 11 illustrates another example of a user interface related to running posture evaluation items in an electronic device according to an embodiment.

In FIG. 10A, reference numeral 1010 denotes a first screen. Reference numeral 1011 denotes a first area indicating a regularity evaluation, from result among the set of running posture evaluation items. Reference numeral 1013 denotes a second area indicating a vertical amplitude evaluation result, from among the set of running posture evaluation items.

In FIG. 10B, reference numeral 1020 denotes a second screen. Reference numeral 1021 denotes a third area indicating a stiffness evaluation result, from among the set of running posture evaluation items. Reference numeral 1023 denotes a fourth area indicating a ground contact time evaluation result, from among the set of running posture evaluation items.

In FIG. 11, reference numeral 1110 denotes a third screen. Reference numeral 1111 denotes a fifth area displaying a running posture comprehensive evaluation result. Reference numeral 1113 denotes a sixth area indicating cadence information according to past exercise zones. The cadence information according to exercise zones displayed in the sixth area 1113 may be an example of past exercise record information. Reference numeral 1115 denotes a seventh area indicating the current average cadence of the user. The current average cadence displayed in the seventh area 1115 may be an example of real-time exercise performance information for the user.

For example, referring to running posture evaluation items shown in the first area 1011 and the second area 1013 in FIG. 10A, the third area 1021 and the fourth area 1023 in FIG. 10B, and the fifth area 1111 in FIG. 11, it can be seen that the left-right asymmetry, regularity, and flight time are evaluated as being "very good" but that the vertical amplitude and stiffness are evaluated as being "not good". This evaluation may indicate that the user failed to run efficiently in exercise. For example, it is likely that running posture is incorrect or has a low cadence level.

In addition, referring to cadence information according to the past exercise zone shown in the sixth area 1113 and the average cadence shown in the seventh area 1115 in FIG. 11, it can be seen that the average cadence value is "163", which belongs to a zone of "5 to 29%" (a lower cadence range) based on the cadence information according to the past exercise zone, indicating that presence cadence is not good.

The electronic device 100 may recognize such a situation as a result of exercise analysis and provide exercise coaching (e.g., coaching to reduce the pace) in consideration of the corresponding situation.

Figure 12:
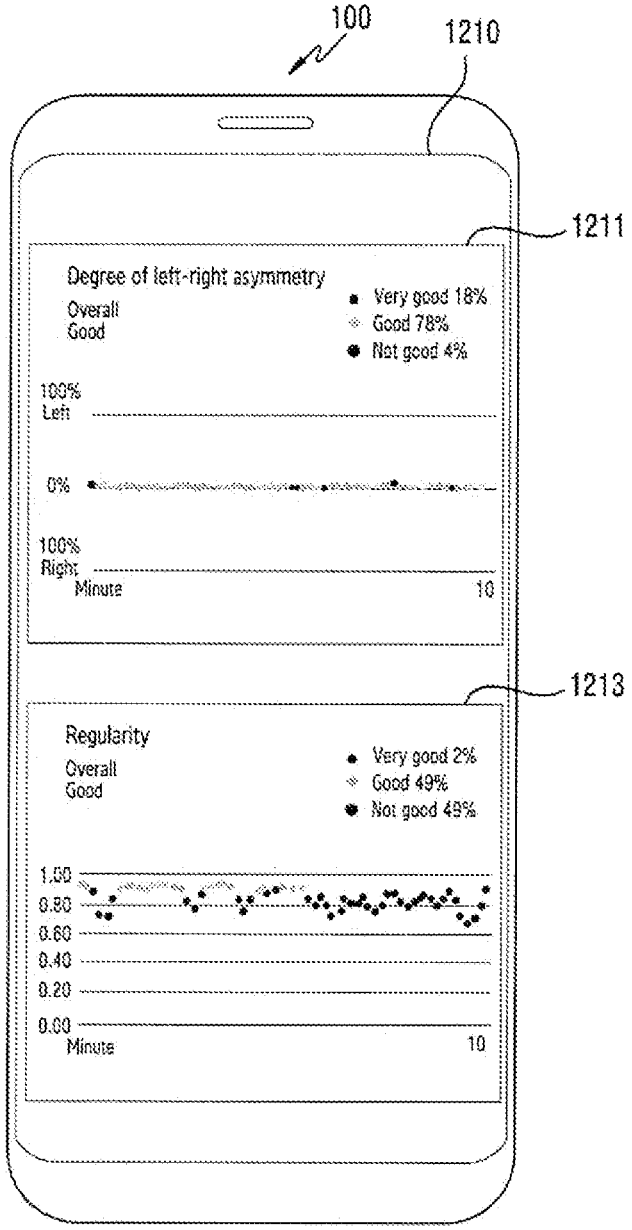
FIG. 12 illustrates another example of a user interface related to a running exercise analysis result in an electronic device according to an embodiment.

FIG. 12 illustrates another example of a user interface related to running posture evaluation items in an electronic device according to an embodiment. For example, a user interface such as the screen 1210 in FIG. 12 may be provided according to a running posture evaluation item.

Exercise evaluation may be performed based on at least some of a specified set of running posture evaluation items (e.g., the degree of left-right asymmetry, regularity, ground contact time, flight time, vertical amplitude, and stiffness).

The screen 1210 may include a first area 1211 indicating an evaluation result of the degree of left-right asymmetry and a second area 1213 indicating the regularity evaluation result.

In an embodiment, coaching for reinforcing the degree of left-right asymmetry and regularity may be provided according to the evaluation results of the degree of left-right asymmetry and regularity.

Figure 13A:
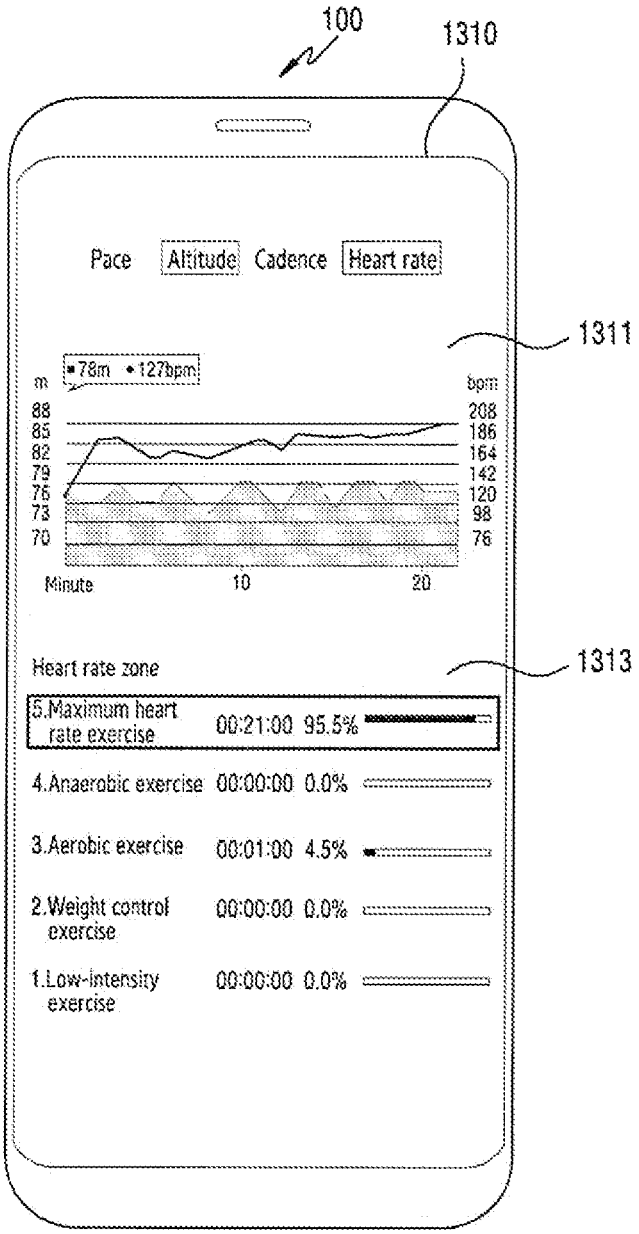
FIG. 13A illustrates another example of a user interface related to running posture evaluation items in an electronic device according to an embodiment.
Figure 13B:
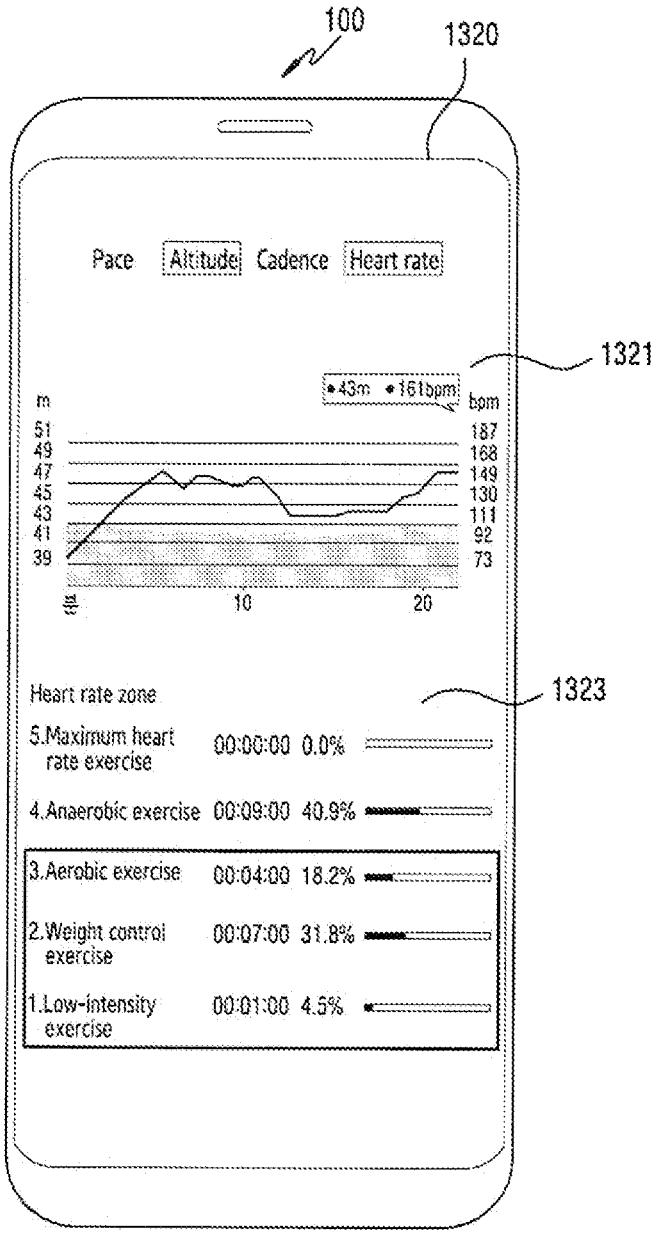
FIG. 13B illustrates another example of a user interface related to running posture evaluation items in an electronic device according to an embodiment.

FIG. 13A illustrates another example of a user interface related to a running exercise analysis result in an electronic device according to an embodiment. FIG. 13B is another example of a user interface related to a running exercise analysis result in an electronic device according to an embodiment. For example, a user interface such as the first screen 1310 in FIG. 13A or the second screen 1320 in FIG. 13B may be provided according to a running exercise analysis result.

In an embodiment, the electronic device 100 may determine whether or not coaching is to be provided based on the current exercise environment information and, if so, execute provision of coaching.

The first screen 1310 in FIG. 13A may include a first area 1311 indicating a current altitude and a current heart rate, and a second area 1313 indicating a running exercise analysis result. The current altitude may be an example of the current exercise environment information. Current heart rate variability may be an example of the real-time exercise performance information. The second screen 1320 in FIG. 13B may include a first area 1321 indicating a current altitude and a current heart rate, and a second area 1323 indicating a running exercise analysis result.

For example, the electronic device 100 may analyze the exercise, based on the current altitude and the current heart rate, and analyze the type of the current exercise as one of low-intensity exercise, weight control exercise, aerobic exercise, anaerobic exercise, and maximum heart rate exercise according to the heart rate ranges. The electronic device 100 may provide a user interface informing of the analysis result or coaching according to the analysis result.

For example, the electronic device 100 may identify an exercise route of the user and, if it is determined that the terrain according to the exercise route is downhill or uphill, may omit provision of coaching prompts, and favor warnings instead. For example, if the average exercise pace of the user is lower or higher than a reference value, the electronic device may generate and output coaching warnings, such as "Be careful of impacts." for safety, instead of providing coaching prompts to alter pace.

For example, if the current heart rate of the user reaches or approaches the maximum heart rate (e.g., or if the user is determined to stay in the maximum heart rate exercise state based on the current heart rate), the electronic device may delay or skip provision of coaching prompts on pace, instead of immediately generating and providing coaching prompts on the pace.

Figure 14A:
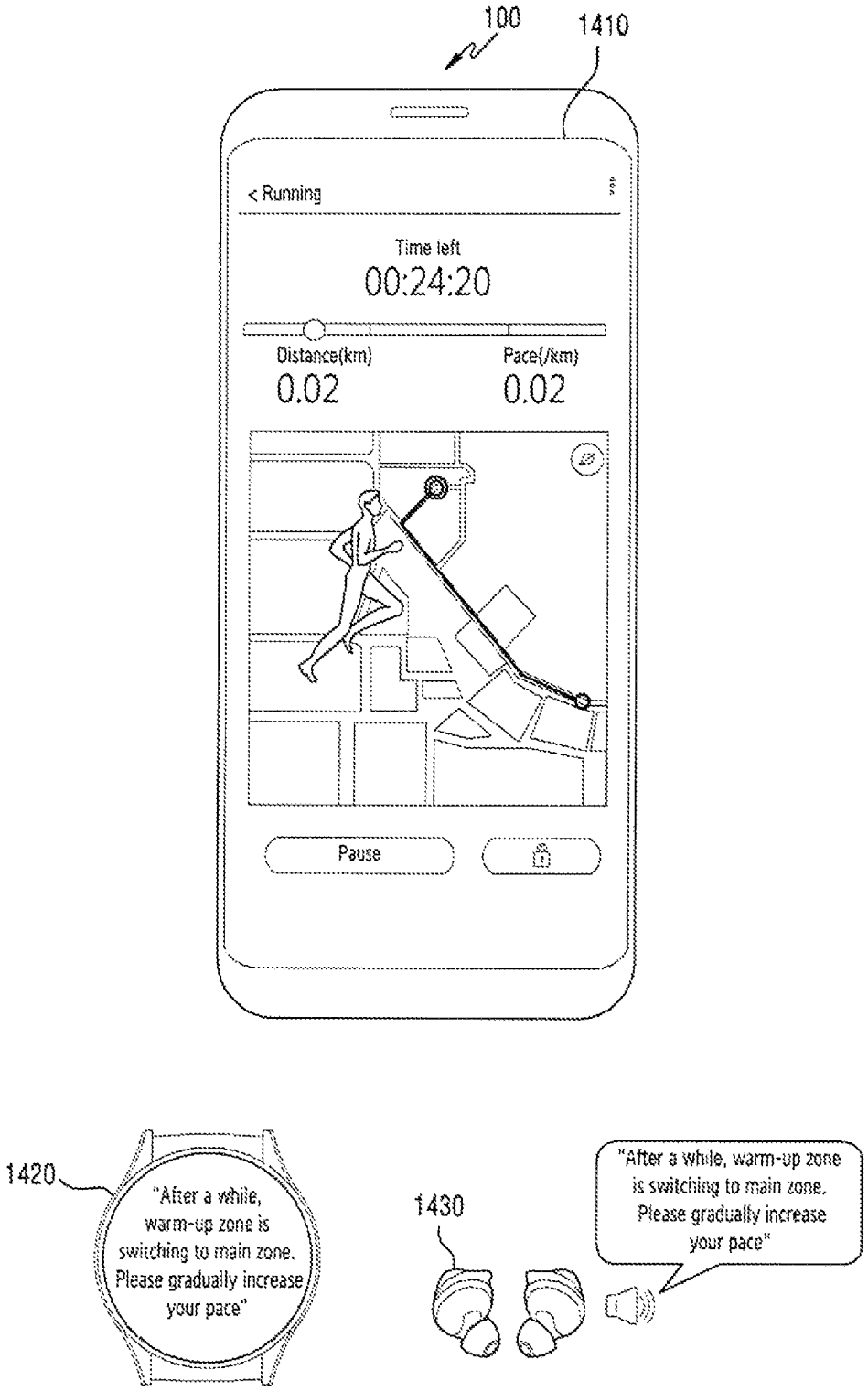
FIG. 14A illustrates an example of a user interface that provides exercise coaching in the case where a current exercise environment is a first place in an electronic device according to an embodiment.

FIG. 14A illustrates an example of a user interface that provides exercise coaching when a current exercise environment is a first place in an electronic device according to an embodiment.

For example, a first place (or current zone) in which the user is exercising may be classified as a transition zone which occurs just before switching from a warm-up zone to a main zone. For example, the electronic device 100 may determine the current zone to be a transition zone, based on real-time exercise performance information (e.g., a running time) of the user. In addition, the electronic device 100 may identify current exercise environment information (e.g., a running direction).

The electronic device 100 may provide a user interface for exercise coaching, based on the current exercise environment information (e.g., a running direction) and the current zone (e.g., a transition zone from a warm-up zone to a main zone).

For example, the electronic device 100 may output a screen 1410 related to exercise coaching by itself and transmit information on a corresponding user interface to at least one of a smartwatch 1420 and/or a wireless ear-set 1430, which is an external electronic device. The information may be intended to request output of a user interface stating "After a while, a warm-up zone is switching to a main zone. Please gradually increase your pace." In response to reception of the information, a message window and/or a voice guide "After a while, a warm-up zone is switching to a main zone. Please gradually increase your pace." may be output through a screen of the smartwatch 1420. A voice guide "After a while, a warm-up zone is switching to a main zone. Please gradually increase your pace." may be output through the wireless ear-set 1430.

Figure 14B:
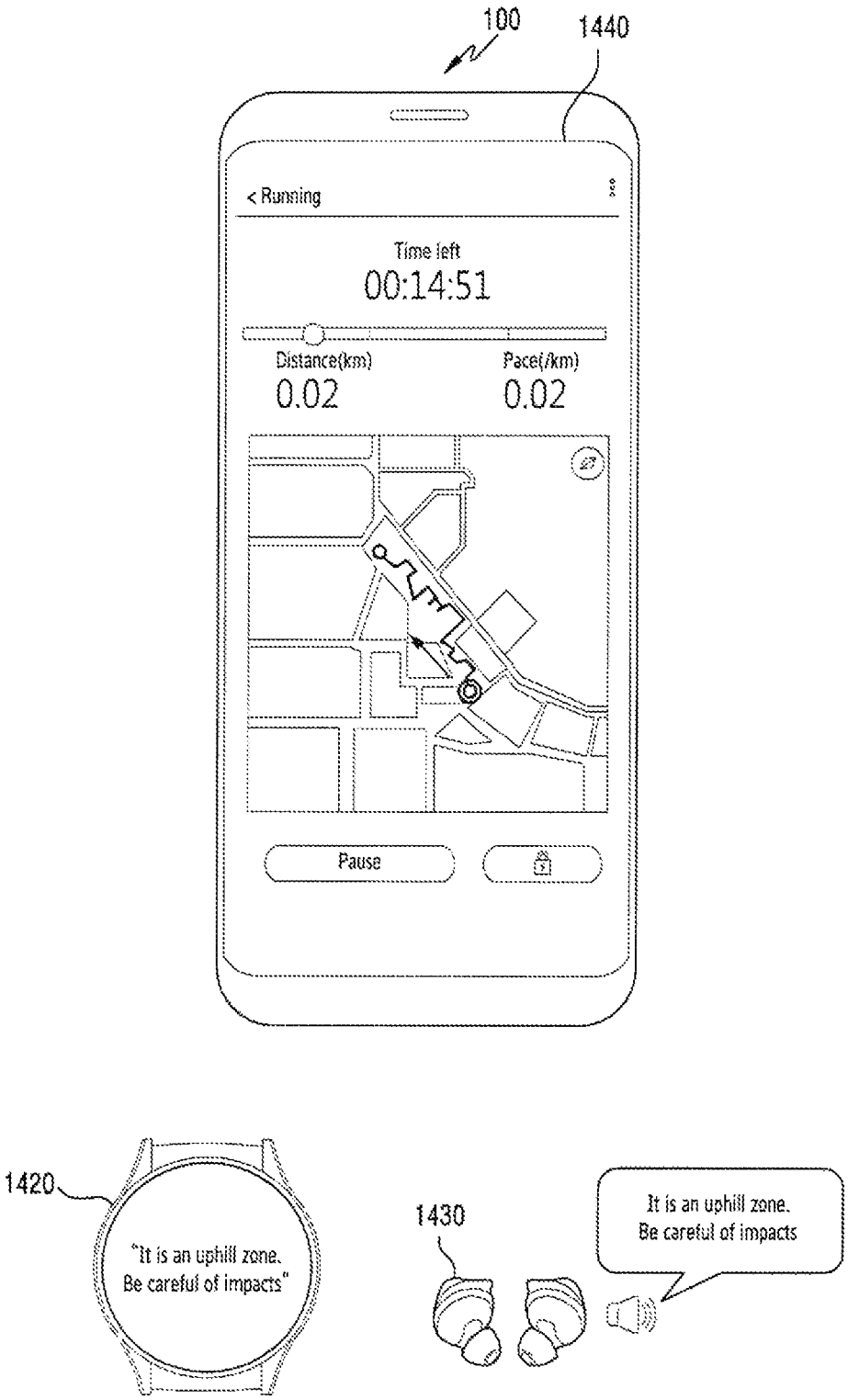
FIG. 14B illustrates an example of a user interface that provides exercise coaching in the case where a current exercise environment is a second place in the electronic device according to an embodiment.

FIG. 14B illustrates an example of a user interface that provides exercise coaching prompts when a current exercise environment is a second place, in an electronic device according to an embodiment.

For example, a second place (or current zone) in which the user is exercising may include an uphill zone. A running direction of the user may be a first direction (e.g., therefore indicating that the user is running an uphill direction).

The electronic device 100 may provide a user interface for outputting exercise coaching prompts, based on current exercise environment information (e.g., a running direction) and the current zone (e.g., an uphill zone).

For example, the electronic device 100 may output a screen 1440 related to exercise coaching by itself, and transmit information on a corresponding user interface to at least one of a smartwatch 1420 and/or a wireless ear-set 1430, which is an external electronic device. The information may be intended to request (e.g., or trigger) output of a user interface stating "It is an uphill zone. Be careful of impacts." In response to reception of the information, a message window and/or a voice guide stating, "It is an uphill zone. Be careful of impacts," may be output through a screen of the smartwatch 1420. A voice guide "It is an uphill zone. Be careful of impacts," may be alternatively or additionally be output through the wireless ear-set 1430.

Figure 14C:
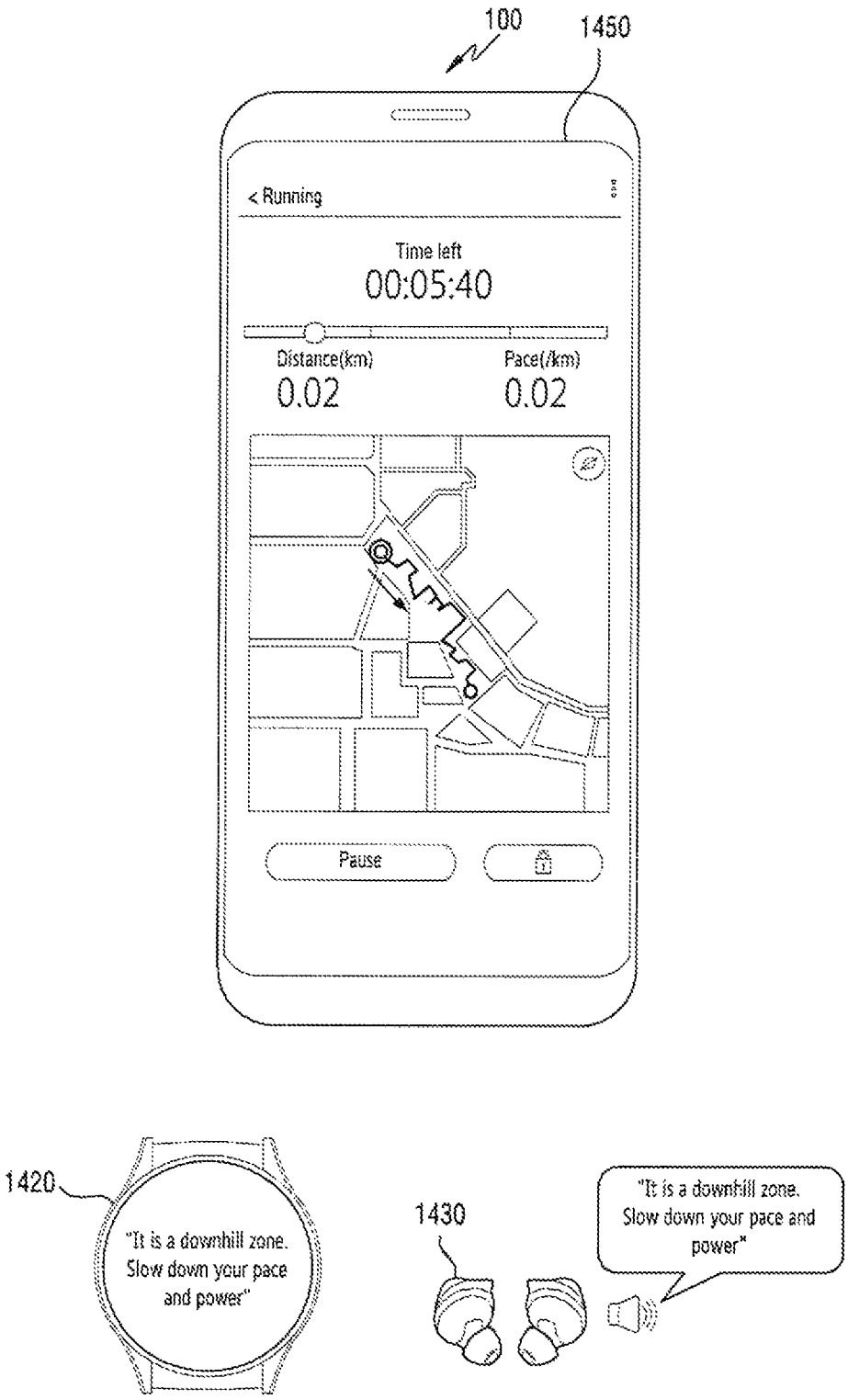
FIG. 14C illustrates an example of a user interface that provides exercise coaching in the case where a current exercise environment is a third place in the electronic device according to an embodiment.

FIG. 14C illustrates an example of a user interface that provides exercise coaching when a current exercise environment is a third place in an electronic device according to an embodiment.

For example, a third place (or current zone) in which the user is exercising may be a downhill zone. A running direction of the user may be a second direction (e.g., a downhill direction).

The electronic device 100 may provide a user interface for exercise coaching, based on current exercise environment information (e.g., a running direction) and the current zone (e.g., a downhill zone).

For example, the electronic device 100 may output a screen 1450 related to exercise coaching by itself and transmit information on a corresponding user interface to at least one of a smartwatch 1420 and/or a wireless ear-set 1430, which may be an external electronic device. The information may be intended to request output of a user interface stating "It is a downhill zone. Slow down your pace and power." In response to reception of the information, a message window and/or a voice guide reproducing, "It is a downhill zone. Slow down your pace and power" may be output through a screen of the smartwatch 1420. A voice guide "It is a downhill zone. Slow down your pace and power" may be output through the wireless ear-set 1430.

Figure 15:
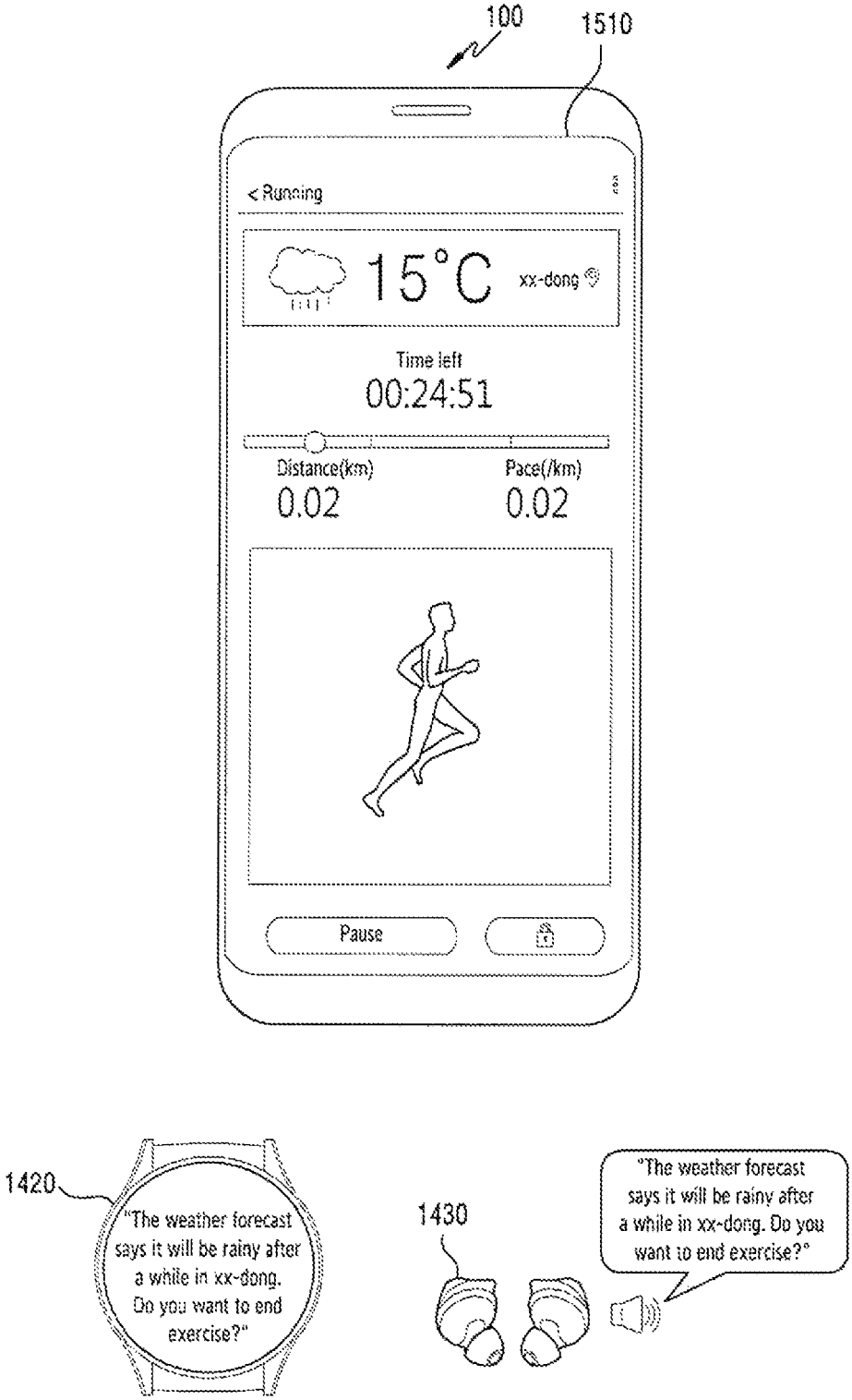
FIG. 15 illustrates an example of a user interface that provides exercise coaching based on a location and weather in a current exercise environment in an electronic device according to an embodiment.

FIG. 15 illustrates an example of a user interface that provides exercise coaching based on a place and weather in a current exercise environment in an electronic device according to an embodiment.

For example, the place (or current zone) where the user is exercising may be a specified area (e.g., "xx" neighborhood). The electronic device 100 may identify the specified area and current weather.

The electronic device 100 may provide a user interface for exercise coaching, based on current exercise environment information (e.g., place, time, and weather).

For example, the electronic device 100 may output a screen 1510 related to exercise coaching by itself and transmit information on a corresponding user interface to at least one of a smartwatch 1420 and/or a wireless ear-set 1430, which is an external electronic device connected to the electronic device 100 through short-range wireless communication. The information may be intended to request output of a user interface stating "The weather forecast says it will be rainy after a while in "xx" neighborhood. Do you want to end the exercise?". In response to reception of the information, a message window and/or a voice guide "The weather forecast says it will be rainy after a while in "xx" neighborhood. Do you want to end the exercise?" may be output through a screen of the smartwatch 1420. A voice guide "The weather forecast says it will be rainy after a while in "xx" neighborhood. Do you want to end the exercise?" may be output through the wireless ear-set 1430.

FIGS. 14A to 14C and 15 illustrate user interfaces that provide personalized exercise coaching, and these user interfaces may be changed, modified, applied, or extended in various ways.

For example, the electronic device 100 may provide a user interface for exercise coaching by reflecting feedback on a result of real-time exercise analysis. For example, the electronic device 100 may output a user interface for exercise coaching through at least one of the electronic device 100, the smartwatch 1420, and the wireless ear-set 1430. For example, a user interface (e.g., at least some of a message window, a voice guide, sound effects, and/or text-based vibration effects) including feedback such as "You are moving your upper body up and down too much. Please adjust the height of your knees.", "Keep your knees at an angle of 150 to 160 degrees, so you can run more effectively for a long time.", "Try to open your chest wide and take a deep breath.", "Straighten your back and waist to make it perpendicular to the ground, so you can run more effectively.", "The degree of left-right symmetry is uneven. Would you like a tempo guide?", and "Keep a natural stride without making it too wide or narrow." may be output.

Figure 16:
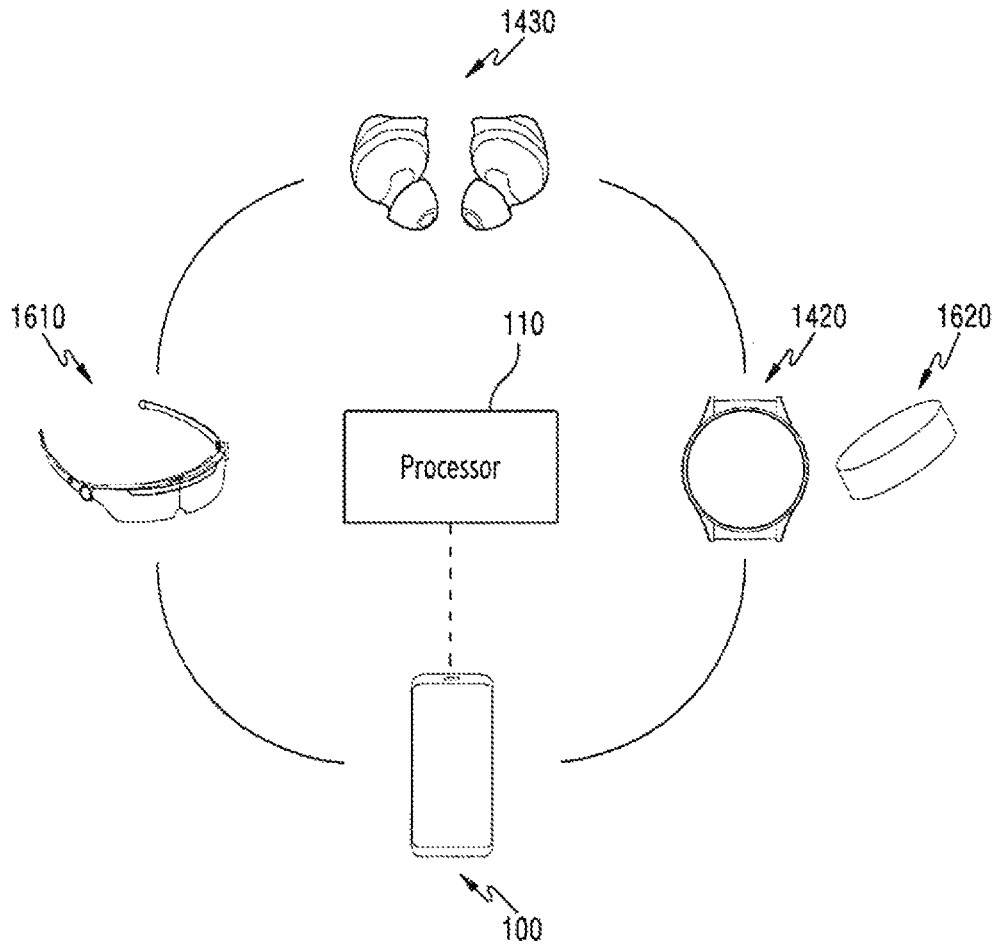
FIG. 16 illustrates an example of various types of user interfaces for providing personalized exercise coaching according to an embodiment.

FIG. 16 illustrates an example of various types of user interfaces for providing personalized exercise coaching according to an embodiment.

For example, the electronic device 100 (or the processor 110 or the personalized coaching engine 200 of the electronic device 100) may determine a coaching providing method, based on at least one of the type of user interface, information about one or more electronic devices that are being worn on the user, and device priority information, and may provide a user interface for exercise coaching, based on the coaching providing method.

During exercise coaching, the electronic device 100 may be in the state of being connected to one or more external electronic devices (e.g., at least some of the smartwatch 1420, the wireless ear-set 1430, the smart glasses 1610, and/or the smart ring 1620) through short-range wireless communication.

In an embodiment, the electronic device 100 may provide various types of user interfaces for exercise coaching depending on a coaching providing method. For example, a user interface for exercise coaching may be provided using at least one of vibration, voice, beep sounds, text, images, screen brightness (or screen flickering), and volume control.

Examples of various coaching providing methods and/or the types of user interfaces are as follows.

As an example, coaching may be provided using vibration. In the case where the smart ring 1620 and the smartwatch 1420 are used, the electronic device 100 may apply a coaching method of distinguishing a wearing direction of the user (e.g., the left or right of the user) and providing vibration to one side (e.g., the left foot) of which the tempo needs to be adjusted more quickly among both sides, thereby increasing the exercise effect. Alternatively, when a risk of injury is detected, a coaching method of providing a longer vibration to one side (e.g., the right arm) where the risk of injury is expected may be applied to support the user to exercise more safely.

As another example, coaching may be provided using a voice (sentences or commands). When providing coaching, a user interface including commands such as "Left foot!, left foot!" conforming to a specified tempo or advices such as "Raise your knees more", including feedback such as "OK!" or "Good job!", may be provided. Alternatively, a user interface that recommends posture and cadence (e.g., "You are moving your upper body too much.", "Try adjusting the height of your knees.", or "Try raising your cadence a little bit more.") may be provided.

As another example, coaching may be provided using beep sounds. In relation to left-right asymmetry or regularity, a user interface may be provided using beep sounds conforming to the tempo. If the user is currently listening to music, a beep sound may be mixed with the music and transmitted to the user in real-time, thereby helping the user to exercise in a more stable posture. If physical strength is reduced in the middle or late stage of exercise, a double beep sound such as "beep beep" may be used to notify that the user is running out of stamina or that the user is exercising too quickly.

As another example, coaching may be provided using text or images. Analysis results of running posture analysis items related to current exercise posture correction (e.g., the degree of left-right asymmetry, flight time, ground contact time, stiffness, vertical amplitude, and regularity) may be displayed on a screen using text or images.

As another example, coaching may be provided using screen brightness or screen blinking. In the case where a plurality of electronic devices is used, screens of the electronic devices may be divided into left and right screens, and a flashing effect of a specific color may be applied to one side screen to help the user to exercise more safely.

As another example, coaching may be provided using volume control. In the case where the user is wearing a wireless ear-set, coaching utilizing the five senses may be provided by transmitting a user interface with different volumes between the left and right of the wireless ear-set.

In an embodiment, the electronic device 100 may interwork with one or more external electronic devices in the connected state through short-range wireless communication according to a coaching providing method, thereby providing various types of user interfaces for exercise coaching.

Various coaching providing methods and/or user interface types according to the type of electronic device used in coaching are exemplified as follows.

For example, when a wireless ear-set 1430 is used, a user interface for exercise coaching may be provided using left and right volume control, music tempo control, tempo, or voices (sentences or commands). When smart glasses 1610 are used, a user interface for exercise coaching may be provided using text or images. When an electronic device 100 such as a smartwatch 1420 or a smartphone is used, a user interface for exercise coaching may be provided using vibration, voices (sentences or commands), or music tempo control.

As another example, when the user wears the wireless ear-set 1430 and the smartwatch 1420, a user interface for exercise coaching is provided using vibration of the smartwatch 1420 and voices, music, or volume of the wireless ear-set 1430.

As another example, when the user wears the wireless ear-set 1430, the smartwatch 1420, and the smart glasses 1610, a user interface for exercise coaching may be provided using vibration of the smartwatch 1420, voices, music, or volume of the wireless ear-set 1430, and text and images displayed on the smart glasses 1610.

As another example, when the user wears the wireless ear-set 1430 and the smartwatch 1420, and carries the smartphone type electronic device 100, a user interface may be provided for exercise coaching using vibration of the smartwatch 1420 and voices, music, or volume of the wireless ear-set 1430. The smartphone type electronic device 100 may not output a user interface for exercise coaching.

FIG. 17 is a block diagram illustrating an electronic device 1701 in a network environment 1700 according to various embodiments.

Referring to FIG. 17, the electronic device 1701 in the network environment 1700 may communicate with an electronic device 1702 via a first network 1798 (e.g., a short-range wireless communication network), or at least one of an electronic device 1704 or a server 1708 via a second network 1799 (e.g., a long-range wireless communication network). According to an embodiment, the electronic device 1701 may communicate with the electronic device 1704 via the server 1708. According to an embodiment, the electronic device 1701 may include a processor 1720, memory 1730, an input module 1750, a sound output module 1755, a display module 1760, an audio module 1770, a sensor module 1776, an interface 1777, a connecting terminal 1778, a haptic module 1779, a camera module 1780, a power management module 1788, a battery 1789, a communication module 1790, a subscriber identification module (SIM) 1796, or an antenna module 1797. In some embodiments, at least one of the components (e.g., the connecting terminal 1778) may be omitted from the electronic device 1701, or one or more other components may be added in the electronic device 1701. In some embodiments, some of the components (e.g., the sensor module 1776, the camera module 1780, or the antenna module 1797) may be implemented as a single component (e.g., the display module 1760).

The processor 1720 may execute, for example, software (e.g., a program 1740) to control at least one other component (e.g., a hardware or software component) of the electronic device 1701 coupled with the processor 1720, and may perform various data processing or computation. According to an embodiment, as at least part of the data processing or computation, the processor 1720 may store a command or data received from another component (e.g., the sensor module 1776 or the communication module 1790) in volatile memory 1732, process the command or the data stored in the volatile memory 1732, and store resulting data in non-volatile memory 1734. According to an embodiment, the processor 1720 may include a main processor 1721 (e.g., a central processing unit (CPU) or an application processor (AP)), or an auxiliary processor 1723 (e.g., a graphics processing unit (GPU), a neural processing unit (NPU), an image signal processor (ISP), a sensor hub processor, or a communication processor (CP)) that is operable independently from, or in conjunction with, the main processor 1721. For example, when the electronic device 1701 includes the main processor 1721 and the auxiliary processor 1723, the auxiliary processor 1723 may be adapted to consume less power than the main processor 1721, or to be specific to a specified function. The auxiliary processor 1723 may be implemented as separate from, or as part of the main processor 1721.

The auxiliary processor 1723 may control at least some of functions or states related to at least one component (e.g., the display module 1760, the sensor module 1776, or the communication module 1790) among the components of the electronic device 1701, instead of the main processor 1721 while the main processor 1721 is in an inactive (e.g., sleep) state, or together with the main processor 1721 while the main processor 1721 is in an active state (e.g., executing an application). According to an embodiment, the auxiliary processor 1723 (e.g., an image signal processor or a communication processor) may be implemented as part of another component (e.g., the camera module 1780 or the communication module 1790) functionally related to the auxiliary processor 1723. According to an embodiment, the auxiliary processor 1723 (e.g., the neural processing unit) may include a hardware structure specified for artificial intelligence model processing. An artificial intelligence model may be generated by machine learning. Such learning may be performed, e.g., by the electronic device 1701 where the artificial intelligence is performed or via a separate server (e.g., the server 1708). Learning algorithms may include, but are not limited to, e.g., supervised learning, unsupervised learning, semi-supervised learning, or reinforcement learning. The artificial intelligence model may include a plurality of artificial neural network layers. The artificial neural network may be a deep neural network (DNN), a convolutional neural network (CNN), a recurrent neural network (RNN), a restricted Boltzmann machine (RBM), a deep belief network (DBN), a bidirectional recurrent deep neural network (BRDNN), deep Q-network or a combination of two or more thereof but is not limited thereto. The artificial intelligence model may, additionally or alternatively, include a software structure other than the hardware structure.

The memory 1730 may store various data used by at least one component (e.g., the processor 1720 or the sensor module 1776) of the electronic device 1701. The various data may include, for example, software (e.g., the program 1740) and input data or output data for a command related thereto. The memory 1730 may include the volatile memory 1732 or the non-volatile memory 1734.

The program 1740 may be stored in the memory 1730 as software, and may include, for example, an operating system (OS) 1742, middleware 1744, or an application 1746.

The input module 1750 may receive a command or data to be used by another component (e.g., the processor 1720) of the electronic device 1701, from the outside (e.g., a user) of the electronic device 1701. The input module 1750 may include, for example, a microphone, a mouse, a keyboard, a key (e.g., a button), or a digital pen (e.g., a stylus pen).

The sound output module 1755 may output sound signals to the outside of the electronic device 1701. The sound output module 1755 may include, for example, a speaker or a receiver. The speaker may be used for general purposes, such as playing multimedia or playing record. The receiver may be used for receiving incoming calls. According to an embodiment, the receiver may be implemented as separate from, or as part of the speaker.

The display module 1760 may visually provide information to the outside (e.g., a user) of the electronic device 1701. The display module 1760 may include, for example, a display, a hologram device, or a projector and control circuitry to control a corresponding one of the display, hologram device, and projector. According to an embodiment, the display module 1760 may include a touch sensor adapted to detect a touch, or a pressure sensor adapted to measure the intensity of force incurred by the touch.

The audio module 1770 may convert a sound into an electrical signal and vice versa. According to an embodiment, the audio module 1770 may obtain the sound via the input module 1750, or output the sound via the sound output module 1755 or a headphone of an external electronic device (e.g., an electronic device 1702) directly (e.g., wiredly) or wirelessly coupled with the electronic device 1701.

The sensor module 1776 may detect an operational state (e.g., power or temperature) of the electronic device 1701 or an environmental state (e.g., a state of a user) external to the electronic device 1701, and then generate an electrical signal or data value corresponding to the detected state. According to an embodiment, the sensor module 1776 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 1777 may support one or more specified protocols to be used for the electronic device 1701 to be coupled with the external electronic device (e.g., the electronic device 1702) directly (e.g., wiredly) or wirelessly. According to an embodiment, the interface 1777 may include, for example, a high definition multimedia interface (HDMI), a universal serial bus (USB) interface, a secure digital (SD) card interface, or an audio interface.

A connecting terminal 1778 may include a connector via which the electronic device 1701 may be physically connected with the external electronic device (e.g., the electronic device 1702). According to an embodiment, the connecting terminal 1778 may include, for example, a HDMI connector, a USB connector, a SD card connector, or an audio connector (e.g., a headphone connector).

The haptic module 1779 may convert an electrical signal into a mechanical stimulus (e.g., a vibration or a movement) or electrical stimulus which may be recognized by a user via his tactile sensation or kinesthetic sensation. According to an embodiment, the haptic module 1779 may include, for example, a motor, a piezoelectric element, or an electric stimulator.

The camera module 1780 may capture a still image or moving images. According to an embodiment, the camera module 1780 may include one or more lenses, image sensors, image signal processors, or flashes.

The power management module 1788 may manage power supplied to the electronic device 1701. According to an embodiment, the power management module 1788 may be implemented as at least part of, for example, a power management integrated circuit (PMIC).

The battery 1789 may supply power to at least one component of the electronic device 1701. According to an embodiment, the battery 1789 may include, for example, a primary cell which is not rechargeable, a secondary cell which is rechargeable, or a fuel cell.

The communication module 1790 may support establishing a direct (e.g., wired) communication channel or a wireless communication channel between the electronic device 1701 and the external electronic device (e.g., the electronic device 1702, the electronic device 1704, or the server 1708) and performing communication via the established communication channel. The communication module 1790 may include one or more communication processors that are operable independently from the processor 1720 (e.g., the application processor (AP)) and supports a direct (e.g., wired) communication or a wireless communication. According to an embodiment, the communication module 1790 may include a wireless communication module 1792 (e.g., a cellular communication module, a short-range wireless communication module, or a global navigation satellite system (GNSS) communication module) or a wired communication module 1794 (e.g., a local area network (LAN) communication module or a power line communication (PLC) module). A corresponding one of these communication modules may communicate with the external electronic device via the first network 1798 (e.g., a short-range communication network, such as Bluetooth™, wireless-fidelity (Wi-Fi) direct, or infrared data association (IrDA)) or the second network 1799 (e.g., a long-range communication network, such as a legacy cellular network, a 5G network, a next-generation communication network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 1792 may identify and authenticate the electronic device 1701 in a communication network, such as the first network 1798 or the second network 1799, using subscriber information (e.g., international mobile subscriber identity (IMSI)) stored in the subscriber identification module 1796.

The wireless communication module 1792 may support a 5G network, after a 4G network, and next-generation communication technology, e.g., new radio (NR) access technology. The NR access technology may support enhanced mobile broadband (eMBB), massive machine type communications (mMTC), or ultra-reliable and low-latency communications (URLLC). The wireless communication module 1792 may support a high-frequency band (e.g., the mmWave band) to achieve, e.g., a high data transmission rate. The wireless communication module 1792 may support various technologies for securing performance on a high-frequency band, such as, e.g., beamforming, massive multiple-input and multiple-output (massive MIMO), full dimensional MIMO (FD-MIMO), array antenna, analog beam-forming, or large scale antenna. The wireless communication module 1792 may support various requirements specified in the electronic device 1701, an external electronic device (e.g., the electronic device 1704), or a network system (e.g., the second network 1799). According to an embodiment, the wireless communication module 1792 may support a peak data rate (e.g., 20 Gbps or more) for implementing eMBB, loss coverage (e.g., 1764 dB or less) for implementing mMTC, or U-plane latency (e.g., 0.5 ms or less for each of downlink (DL) and uplink (UL), or a round trip of 17 ms or less) for implementing URLLC.

The antenna module 1797 may transmit or receive a signal or power to or from the outside (e.g., the external electronic device) of the electronic device 1701. According to an embodiment, the antenna module 1797 may include an antenna including a radiating element implemented using a conductive material or a conductive pattern formed in or on a substrate (e.g., a printed circuit board (PCB)). According to an embodiment, the antenna module 1797 may include a plurality of antennas (e.g., array antennas). In such a case, at least one antenna appropriate for a communication scheme used in the communication network, such as the first network 1798 or the second network 1799, may be selected, for example, by the communication module 1790 (e.g., the wireless communication module 1792) from the plurality of antennas. The signal or the power may then be transmitted or received between the communication module 1790 and the external electronic device via the selected at least one antenna. According to an embodiment, another component (e.g., a radio frequency integrated circuit (RFIC)) other than the radiating element may be additionally formed as part of the antenna module 1797.

According to various embodiments, the antenna module 1797 may form a mmWave antenna module. According to an embodiment, the mmWave antenna module may include a printed circuit board, a RFIC disposed on a first surface (e.g., the bottom surface) of the printed circuit board, or adjacent to the first surface and capable of supporting a designated high-frequency band (e.g., the mmWave band), and a plurality of antennas (e.g., array antennas) disposed on a second surface (e.g., the top or a side surface) of the printed circuit board, or adjacent to the second surface and capable of transmitting or receiving signals of the designated high-frequency band.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 1701 and the external electronic device 1704 via the server 1708 coupled with the second network 1799. Each of the electronic devices 1702 or 1704 may be a device of a same type as, or a different type, from the electronic device 1701. According to an embodiment, all or some of operations to be executed at the electronic device 1701 may be executed at one or more of the external electronic devices 1702, 1704, or 1708. For example, if the electronic device 1701 should perform a function or a service automatically, or in response to a request from a user or another device, the electronic device 1701, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 1701. The electronic device 1701 may provide the outcome, with or without further processing of the outcome, as at least part of a reply to the request. To that end, a cloud computing, distributed computing, mobile edge computing (MEC), or client-server computing technology may be used, for example. The electronic device 1701 may provide ultra low-latency services using, e.g., distributed computing or mobile edge computing. In another embodiment, the external electronic device 1704 may include an internet-of-things (IoT) device. The server 1708 may be an intelligent server using machine learning and/or a neural network. According to an embodiment, the external electronic device 1704 or the server 1708 may be included in the second network 1799. The electronic device 1701 may be applied to intelligent services (e.g., smart home, smart city, smart car, or healthcare) based on 5G communication technology or IoT-related technology.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used in connection with various embodiments of the disclosure, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 1740) including one or more instructions that are stored in a storage medium (e.g., internal memory 1736 or external memory 1738) that is readable by a machine (e.g., the electronic device 1701). For example, a processor (e.g., the processor 1720) of the machine (e.g., the electronic device 1701) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities, and some of the multiple entities may be separately disposed in different components. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

An electronic device (e.g., the electronic device 100 or the processor 110 in FIG. 1, the coaching engine 200 in FIG. 2, or the electronic device 1701 in FIG. 17) according to various embodiments may include a memory (e.g., the memory 120 in FIG. 1 or the memory 1730 in FIG. 17), a communication circuit (e.g., the communication circuit 130 in FIG. 1 or the communication module 1790 in FIG. 17), a sensor module (e.g., the sensor module 140 in FIG. 1 or the sensor module 1776 in FIG. 17), an output module (e.g., the output module 150 in FIG. 1, or the display module 1760, the audio module 1770, the sound output module 1755, or the haptic module 1779 in FIG. 17), and at least one processor (e.g., the processor 110 in FIG. 1 or the processor 1720 in FIG. 17) operably connected to the memory, the communication circuit, the sensor module, and the output module, wherein the memory may store instructions that, when executed, cause the at least one processor to detect real-time exercise performance information according to movement of a user through the sensor module, obtain current exercise environment information using the sensor module or the communication circuit, and provide a user interface (e.g., FIG. 7A, FIG. 7B, FIG. 8A, FIG. 8B, FIG. 8C, FIG. 8D, FIG. 9, FIG. 10A, FIG. 10B, FIG. 11, FIG. 12, FIG. 13A, FIG. 13B, FIG. 14A, FIG. 14B, FIG. 14C, FIG. 15, or FIG. 16) for exercise coaching through the output module or the communication circuit, based on past exercise record information corresponding to the current exercise environment information, profile information of the user, and the real-time exercise performance information.

According to various embodiments, the current exercise environment information may include one or more pieces of place information, weather situation information, and user situation information.

According to various embodiments, the past exercise record information may correspond to at least one of a place, a weather situation, and a user situation indicated by the current exercise environment information.

According to various embodiments, the place information may include information about one or more of a location and terrain. The weather situation information may include information about one or more of weather, temperature, humidity, wind direction, and wind strength. The user situation information may include information about one or more of an exercise direction and an exercise route.

According to various embodiments, past exercise record information corresponding to a current zone may be obtained based on the current exercise environment information. A user interface for exercise coaching for the current zone may be provided based on the past exercise record information.

According to various embodiments, past exercise record information corresponding to a current zone and a next zone of the current zone may be obtained based on the current exercise environment information. A user interface for exercise coaching for the next zone may be provided based on the past exercise record information.

According to various embodiments, past exercise record information for an entire exercise zone including a current zone may be obtained based on the current exercise environment information. A user interface for exercise coaching for each of a plurality of zones of the entire exercise zone may be provided based on the past exercise record information.

According to various embodiments, the instructions, when executed, may cause the at least one processor to determine whether a current zone belongs to a warm-up zone, a main exercise zone, and a cool-down zone in an entire exercise zone based on the real-time exercise performance information, and provide a user interface for exercise coaching by further considering the zone to which the current zone belongs.

According to various embodiments, the instructions, when executed, may cause the at least one processor to determine a current state to be one of a pre-exercise state, an in-exercise state, and a post-exercise state, based on the real-time exercise performance information, and provide a user interface for exercise coaching by further considering the state corresponding to the current state.

According to various embodiments, information on the user interface may be transmitted, through the communication circuit, to one or more external electronic devices connected to the electronic device through short-range wireless communication.

According to various embodiments, a coaching providing method may be determined based on at least one of the type of user interface, information on one or more electronic devices worn on the user, and device priority information. A user interface for the exercise coaching may be provided based on the coaching providing method.

According to various embodiments, the user interface may be intended for coaching running and may be related to information about one or more of the degree of left-right asymmetry, flight time, ground contact time, stiffness, vertical amplitude, and regularity according to running posture evaluation items.

An operating method of an electronic device according to various embodiments may include detecting real-time exercise performance information according to movement of a user, obtaining current exercise environment information, and providing a user interface for exercise coaching, based on past exercise record information corresponding to the current exercise environment information, profile information of the user, and the real-time exercise performance information.

According to various embodiments, the providing of a user interface for exercise coaching may include obtaining past exercise record information corresponding to a current zone and a next zone of the current zone, based on the current exercise environment information, and providing a user interface for exercise coaching for the next zone, based on the past exercise record information.

According to various embodiments, the providing of a user interface for exercise coaching may include past exercise record information for an entire exercise zone including a current zone, based on the current exercise environment information, and providing a user interface for exercise coaching for each of a plurality of zones of the entire exercise zone, based on the past exercise record information.

According to various embodiments, the method may further include determining whether a current zone belongs to a warm-up zone, a main exercise zone, and a cool-down zone in an entire exercise zone based on the real-time exercise performance information. A user interface for exercise coaching may be provided by further considering the zone to which the current zone belongs.

According to various embodiments, the method may further include determining a current state to be one of a pre-exercise state, an in-exercise state, and a post-exercise state, based on the real-time exercise performance information. A user interface for exercise coaching may be provided by further considering the state corresponding to the current state.

What is claimed is:

1. An electronic device, comprising:

communication circuitry for communicating with a wearable electronic device worn by a user;

a sensor module;

an output module;

at least one processor, and memory storing instructions that, when executed by the at least one processor, cause the electronic device to:

detect, through the sensor module, movement of the user corresponding to real-time performance of a running exercise by the user, evaluate the user's first running posture of a warm-up period after starting the running exercise, evaluate the user's second running posture of a main exercise period after the warm-up period, determine a device among the electronic device and the wearable electronic device based on evaluation result of the user's first running posture and the user's second running posture, determine a type of a user interface (UI) based on the determined device, output, through the determined device, the UI including guidance for performance of the running exercise based on the determined type.

2. The electronic device of claim 1, wherein the instructions, when executed by the at least one processor, cause the electronic device to:

determine a type of current zone, including at least one of a warm-up zone, a main exercise zone, and a cool-down zone among a plurality of exercise zones of an entire exercise zone, based on real-time performance of the running exercise, and configure the UI based at least in part on the determined type of the current zone.

3. The electronic device of claim 1, wherein the instructions, when executed by the at least one processor, cause the electronic device to:

determine a current state of the user, including one of a pre-exercise state, an in-exercise state, and a post-exercise state, based on the real-time performance of the running exercise, and configure the UI based in part on the determined state.

4. The electronic device of claim 1, wherein information on the UI is transmitted, via the communication circuitry, to the wearable electronic devices communicatively coupled to the electronic device through short-range wireless communication.

5. The electronic device of claim 1, wherein a format of the guidance of performance of the running exercise is selected based on at least one of: the type of the UI, identification of the wearable electronic devices worn by the user, and device priority information, and wherein the UI is configured based on the selected format.

6. The electronic device of claim 1, the UI is configured to indicate one or more of left-right asymmetry, flight time, ground contact time, stiffness, vertical amplitude and gait regularity.

7. An operating method of an electronic device, the method comprising:

detecting movement of a user corresponding to real-time performance of a running exercise by the user;

evaluating the user's first running posture of a warm-up period after starting the running exercise, evaluating the user's second running posture of a main exercise period after the warm-up period, determining a device among the electronic device and a wearable electronic device based on evaluation result of the user's first running posture and the user's second running posture, determining a type of a user interface (UI) based on the determined device, outputting, through the determined device, the UI including guidance for performance of the running exercise based on the determined type.

8. The method of claim 7, further comprising:

determining a type of current zone, including at least one of a warm-up zone, a main exercise zone, and a cool-down zone among a plurality of exercise zones of an entire exercise zone, based on real-time performance of the running exercise, and configuring the UI based at least in part on the determined type of the current zone.

9. The method of claim 7, further comprising:

determining a current state of the user, including one of a pre-exercise state, an in-exercise state, and a post-exercise state, based on the real-time performance of the running exercise, and configuring the UI based in part on the determined state.

10. The method of claim 7, wherein information on the UI is transmitted to the wearable electronic device communicatively coupled to the electronic device through short-range wireless communication.

11. The method of claim 7, wherein a format of the guidance of performance of the running exercise is selected based on at least one of: the type of the UI, identification of the wearable electronic device worn by the user, and device priority information, and wherein the UI is configured based on the selected format.

12. The method of claim 7, the UI is configured to indicate one or more of left-right asymmetry, flight time, ground contact time, stiffness, vertical amplitude and gait regularity.

* * * * *